US010325587B2

(12) United States Patent
Asada

(10) Patent No.: US 10,325,587 B2
(45) Date of Patent: Jun. 18, 2019

(54) NOISE REDUCING DEVICE, NOISE REDUCING METHOD, NOISE REDUCING PROGRAM, AND NOISE REDUCING AUDIO OUTPUTTING DEVICE

(71) Applicant: SONY CORPORATION, Tokyo (JP)

(72) Inventor: Kohei Asada, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/617,494

(22) Filed: Jun. 8, 2017

(65) Prior Publication Data

US 2017/0270905 A1 Sep. 21, 2017

Related U.S. Application Data

(63) Continuation of application No. 11/865,354, filed on Oct. 1, 2007, now Pat. No. 9,741,332.

(30) Foreign Application Priority Data

Nov. 14, 2006 (JP) ..... 2006-307364

(51) Int. Cl.
*G10K 11/178* (2006.01)
*H04R 1/10* (2006.01)

(52) U.S. Cl.
CPC ..... *G10K 11/178* (2013.01); *G10K 11/1783* (2018.01); *G10K 11/17823* (2018.01);
(Continued)

(58) Field of Classification Search
CPC ... G10K 2210/3016; G10K 2210/3025; G10K 2210/3033; G10K 2210/30351;
(Continued)

(56) References Cited

U.S. PATENT DOCUMENTS 5,276,740 A 1/1994 Inanaga et al.
5,652,770 A 7/1997 Eatwell
(Continued)

FOREIGN PATENT DOCUMENTS

EP 1 538 601 A2 6/2005
EP 1 074 971 A2 2/2007
(Continued)

OTHER PUBLICATIONS

S.J. Elliott, "Down with noise," IEEE Spectrum, vol. 36, pp. 54-61, Jun. 1999.*
(Continued)

*Primary Examiner* — Duc Nguyen
*Assistant Examiner* — Kile O Blair
(74) *Attorney, Agent, or Firm* — Oblon, McClelland, Maier & Neustadt, L.L.P.

(57) ABSTRACT

A noise reducing device includes: an acoustic-to-electric conversion section for collecting noise and outputting an analog noise signal; an analog-to-digital conversion section for converting the analog noise signal into a digital noise signal; and a digital processing section for generating a digital noise reducing signal on a basis of the digital noise signal and a desired parameter. The device further includes: a retaining section for retaining a plurality of parameters corresponding to a plurality of kinds of noise characteristics; a setting section for setting one of the plurality of parameters as the desired parameter of the digital processing section; a digital-to-analog conversion section for converting the digital noise reducing signal into an analog noise reducing signal; and an electric-to-acoustic conversion section for outputting noise reducing sound on a basis of the analog noise reducing signal.

26 Claims, 27 Drawing Sheets

(52) U.S. Cl.
CPC .. *G10K 11/17825* (2018.01); *G10K 11/17833* (2018.01); *G10K 11/17873* (2018.01); *G10K 11/17875* (2018.01); *G10K 11/17879* (2018.01); *G10K 11/17885* (2018.01); *H04R 1/1083* (2013.01); *G10K 2210/1081* (2013.01); *G10K 2210/3013* (2013.01); *G10K 2210/3033* (2013.01); *G10K 2210/3042* (2013.01); *G10K 2210/30391* (2013.01); *G10K 2210/3222* (2013.01); *G10K 2210/509* (2013.01); *H04R 2460/01* (2013.01)

(58) Field of Classification Search
CPC . G10K 2210/30391; G10K 2210/3048; G10K 2210/3057; G10K 2210/3054; G10K 2210/3055; G10K 2210/30232
See application file for complete search history.

(56) References Cited

U.S. PATENT DOCUMENTS

| | | | | |
|---|---|---|---|---|
| 6,449,369 | B1 | 9/2002 | Carme et al. | |
| 6,522,753 | B1 * | 2/2003 | Matsuzawa | G10K 11/178 381/123 |
| 6,741,707 | B2 | 5/2004 | Ray et al. | |
| 7,034,731 | B2 | 4/2006 | Uramoto et al. | |
| 7,050,966 | B2 | 5/2006 | Schneider et al. | |
| 7,308,106 | B2 * | 12/2007 | Vaudrey | G10K 11/1788 381/72 |
| 8,031,878 | B2 | 10/2011 | Gauger et al. | |
| 8,130,971 | B2 * | 3/2012 | Werner | G10K 11/1788 381/23.1 |
| 2003/0228019 | A1 * | 12/2003 | Eichler | H04R 1/1008 381/71.8 |
| 2004/0222908 | A1 | 11/2004 | MacDonald et al. | |
| 2007/0033029 | A1 | 2/2007 | Sakawaki | |

FOREIGN PATENT DOCUMENTS

| | | | |
|---|---|---|---|
| GB | 2222733 | A | 3/1990 |
| JP | H03-096199 | | 4/1991 |
| JP | H03-214892 | | 9/1991 |
| JP | H03-274898 | A | 12/1991 |
| JP | H05-036991 | U | 5/1993 |
| JP | H05-188977 | A | 7/1993 |
| JP | H06-059689 | | 3/1994 |
| JP | H07-098592 | | 4/1995 |
| JP | H07-104767 | A | 4/1995 |
| JP | H08-123438 | A | 5/1996 |
| JP | H08-307501 | | 11/1996 |
| JP | H09-054592 | A | 2/1997 |
| JP | H09-218687 | A | 8/1997 |
| JP | H10-171469 | | 6/1998 |
| JP | H10-214118 | | 8/1998 |
| JP | H07-056579 | | 3/1999 |
| JP | 2000-059876 | | 2/2000 |
| JP | 2001-005463 | A | 1/2001 |
| JP | 2005-257720 | A | 9/2005 |
| JP | 2005-331571 | A | 12/2005 |

OTHER PUBLICATIONS

Extended European Search Report dated May 31, 2016, in European Application No. 07120658.5.
Office Action dated Apr. 8, 2014 in Japanese Application No. 2012-267956 (with English translation).
Office Action dated Jan. 27, 2015 in Japanese Application No. 2012-267956 (with English translation).
Office Action dated Apr. 16, 2013 in Japanese Application No. 2012-024278.
Office Action dated Oct. 1, 2013 in Japanese Application No. 2012-024278.
Office Action dated Dec. 6, 2011 in Japanese Application No. 2006-307364.
Office Action dated Oct. 2, 2012 in Japanese Application No. 2006-307364.
Extended European Search Report dated Oct. 29, 2018 in corresponding European Patent Application No. 18169076.9, 11 pages.
Office Action dated Mar. 22, 2019 in European Patent Application No., 07120658.5, 10 pages (The references cited therein were previously cited and/or filed).

* cited by examiner

FIG. 3

$$P = \frac{1}{1 + ADHM\beta} N + \frac{AHD}{1 + ADHM\beta} ES \quad \cdots \text{(EQUATION 1)}$$

$$\left| \frac{1}{1 + ADHM\beta} \right| < 1 \quad \cdots \text{(EQUATION 2)}$$

$$E = (1 + ADHM\beta) \quad \cdots \text{(EQUATION 3)}$$

$$P = \frac{1}{1 + ADHM\beta} N + ADHS \quad \cdots \text{(EQUATION 4)}$$

$$P = -F' ADHM\alpha N + FN + ADHS \quad \cdots \text{(EQUATION 5)}$$

$$P = -F' ADHM\alpha \quad \cdots \text{(EQUATION 6)}$$

$$P = ADHS \quad \cdots \text{(EQUATION 7)}$$

NOISE REDUCING DEVICE, NOISE REDUCING METHOD, NOISE REDUCING PROGRAM, AND NOISE REDUCING AUDIO OUTPUTTING DEVICE

CROSS REFERENCES TO RELATED APPLICATIONS

This is a continuation of U.S. application Ser. No. 11/865,354, filed Oct. 1, 2007, which is claims priority to Japanese Patent Application JP 2006-307364, filed in the Japan Patent Office on Nov. 14, 2006, the entire contents of which are incorporated herein by reference.

BACKGROUND OF THE INVENTION

1. Field of the Invention

The present invention relates to a noise reducing device, a noise reducing method, a program for noise reduction processing, and a noise reducing audio outputting device.

2. Description of the Related Art

With the spread of portable type audio players, a noise reducing system that reduces noise of an external environment and thus provides a listener with a good reproduced sound field space in which the external noise is reduced has begun to be spread for headphones and earphones for the portable type audio players.

An example of this kind of noise reducing system is an active type noise reducing system that performs active noise reduction and which basically has the following constitution. External noise is collected by a microphone as acoustic-to-electric converting means. A noise reducing audio signal of acoustically opposite phase from the noise is generated from an audio signal of the collected noise. The generated noise reducing audio signal is acoustically reproduced by a speaker as electric-to-acoustic converting means, whereby the noise reducing audio signal and the noise are acoustically synthesized. Thus the noise is reduced (see Japanese Patent No. 2778173, hereinafter referred to as Patent Document 1).

In this active type noise reducing system, conventionally, a part for generating the noise reducing audio signal is formed by an analog circuit (analog filter), and is fixed as a filter circuit that can perform some degree of noise reduction in any noise environment.

In addition, a headphone device has been proposed which includes a noise reducing system employing an adaptive filter using adaptive processing and which can reproduce music even in an environment with a high level of external noise in a state of the noise being reduced (see Japanese Patent No. 2867461, hereinafter referred to as Patent Document 2).

The noise reducing system of a noise reducing headphone described in Patent Document 2 automatically sets the adaptive filter to an optimum filter using adaptive signal processing. A microphone for collecting external noise is provided on the outside of a headphone casing, and a microphone for collecting the sound of a residual (error) component as a result of acoustic synthesis based on the adaptive signal processing is provided inside the headphone casing.

In the noise reducing system using the adaptive processing, a residual signal from the microphone provided within the headphone casing is analyzed, and the adaptive filter is updated, whereby adaptive noise reduction is performed on the external noise.

SUMMARY OF THE INVENTION

Generally, noise environment characteristics differ greatly according to the environment of a place such as an airport, a platform in a railway station, a factory, and the like even when the noise environment characteristics are observed as frequency characteristics. It is therefore desirable that an optimum filter characteristic adjusted to each noise environment characteristic be normally used as a filter characteristic for noise reduction.

However, as described above, the existing active type noise reducing system is fixed to a filter circuit having a single filter characteristic such as can perform some degree of noise reduction in any noise environment. The conventional active type noise reducing system has a problem of being unable to perform noise reduction adapted to the noise environment characteristic of a place where the noise reduction is to be performed.

Accordingly, a plurality of filter circuits with various filter characteristics may be provided in place of a filter circuit with a single filter characteristic, so that a filter circuit adapted to the noise environment characteristic of a place is selected by switching. In this case, because the filter circuit is traditionally of an analog circuit configuration, a hardware circuit itself is changed.

However, the constitution in which the plurality of filter circuits are thus provided and one of the filter circuits is selected by switching presents problems of an increase in the scale of hardware configuration and an increase in cost. Therefore the constitution is not practical as a noise reducing system for use with a portable device.

On the other hand, the noise reducing system using the adaptive processing updates the adaptive filter adaptively such that the adaptive filter is adapted to noise in a place where the noise reducing system is to be used. It is therefore unnecessary to provide a plurality of filter circuits.

Hence, a large number of methods of reducing (canceling) noise using adaptive signal processing have been proposed in patent documents, publications of academic societies, and the like. The methods, however, have not clear up problems including a problem of system stability, an increase in processing scale, suitability for only periodic noise waveforms, cost effectiveness (cost performance), and the like. Therefore the methods are not actually commercialized in a present situation.

The present invention has been made in view of the above. It is desirable to provide a noise reducing device that can perform noise reduction corresponding properly to a noise environment while adopting an active type noise reducing system that does not use adaptive processing.

According to an embodiment of the present invention, there is provided a noise reducing device including: an acoustic-to-electric conversion section for collecting noise and outputting an analog noise signal; an analog-to-digital conversion section for converting the analog noise signal into a digital noise signal; a digital processing section for generating a digital noise reducing signal on a basis of the digital noise signal and a desired parameter; a retaining section for retaining a plurality of parameters corresponding to a plurality of kinds of noise characteristics; a setting section for setting one of the plurality of parameters as the desired parameter of the digital processing section; a digital-to-analog conversion section for converting the digital noise reducing signal into an analog noise reducing signal; and an electric-to-acoustic conversion section for outputting noise reducing sound on a basis of the analog noise reducing signal.

The noise reducing device of the above-described configuration performs active type noise reduction. The noise reducing audio signal is generated by the digital processing section. The retaining section retains a plurality of parameters corresponding to noise characteristics corresponding to various noise environments. The digital processing section can generate a noise reducing audio signal using the parameter of an appropriate noise characteristic among the plurality of parameters. It is therefore possible to perform noise reductions corresponding appropriately with various noise environments.

In this case, a hardware configuration suffices which only retains a plurality of parameters corresponding to a plurality of kinds of noise characteristics in the retaining section and has a selecting and setting section for selecting one of the parameters. Therefore the scale of the hardware configuration does not become large as compared with a case of using an analog filter circuit. That is, even when various noise characteristics are to be handled, it suffices only to retain a plurality of parameters corresponding to the various noise characteristics. Thus, as compared with a case of providing a large number of analog filter circuits and performing switching between the analog filter circuits, the configuration is simpler and more advantageous in terms of cost.

According to the present invention, even when an active type noise reducing method is used, it is possible to perform noise reductions corresponding appropriately with various noise environments, and prevent a circuit scale from becoming large. Thus a noise reducing device practical in terms of cost can be realized.

BRIEF DESCRIPTION OF THE DRAWINGS

FIG. 3 is a diagram of assistance in explaining the embodiment of the noise reducing device according to the present invention;

DETAILED DESCRIPTION OF PREFERRED EMBODIMENTS

Several embodiments of a noise reducing device according to the present invention will hereinafter be described with reference to the drawings. In each of the embodiments to be described below, the noise reducing device according to the present invention is applied to a headphone device as an embodiment of a noise reducing audio output device according to the present invention.

Systems that perform active noise reduction include a feedback system (feedback type) and a feed forward system (feed forward type). The present invention can be applied to both noise reduction systems.

There are two systems for changing a characteristic in the noise reducing device according to a noise environment: a manual selection system that changes the characteristic according to a selecting instruction of a user, and an automatic selection system that changes the characteristic automatically according to the noise environment.

Manual Selection System

First Embodiment (Noise Reducing Device of Feedback Type)

Figure 1:
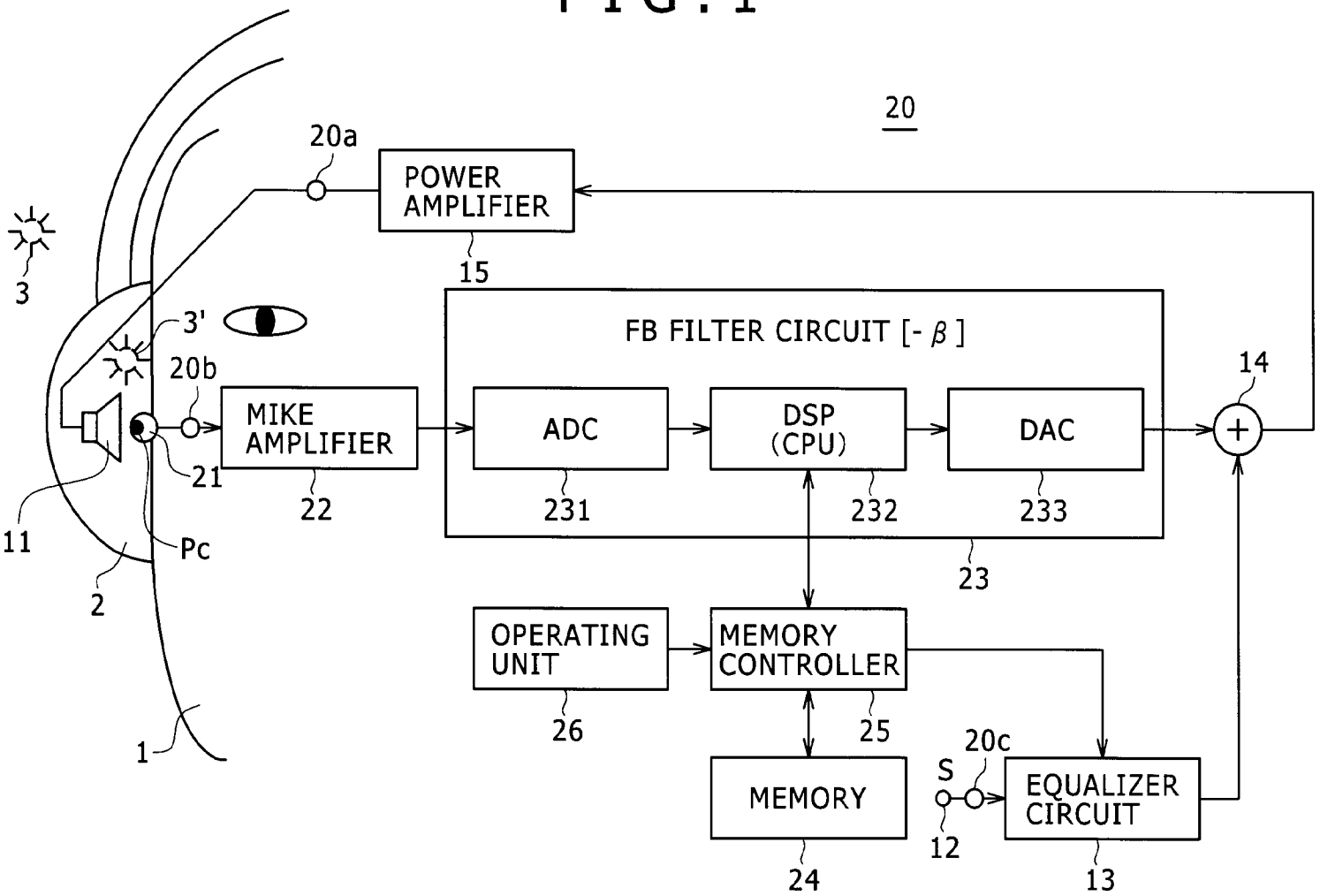
FIG. 1 is a block diagram showing an example of a headphone device to which a noise reducing device according to a first embodiment of the present invention is applied.

Description will first be made of an embodiment in which the present invention is applied to a noise reducing system of a feedback type. FIG. 1 is a block diagram showing an example of configuration of an embodiment of a headphone device to which an embodiment of the noise reducing device according to the present invention is applied.

For simplicity of description, FIG. 1 shows the configuration of only a part of the headphone device for the right ear side of a listener 1. The same is true for embodiments to be described later. Incidentally, it is needless to say that a part for a left ear side is configured in the same manner.

FIG. 1 shows a state in which the listener 1 wears the headphone device according to the embodiment and thereby the right ear of the listener 1 is covered by a headphone casing (housing unit) 2 for the right ear. A headphone driver unit (hereinafter referred to simply as a driver) 11 as electric-to-acoustic converting means for acoustically reproducing an audio signal as an electric signal is provided inside the headphone casing 2.

A music signal, for example, after passing through an audio signal input terminal 12 is supplied through an equalizer circuit 13 and an adding circuit 14 to a power amplifier 15. The music signal is supplied through the power amplifier 15 to the driver 11 and then acoustically reproduced, whereby the reproduced sound of the music signal is emitted to the right ear of the listener 1.

The audio signal input terminal 12 is formed by a headphone plug to be inserted into a headphone jack of a portable music reproducing device. Provided in an audio signal transmission line between the audio signal input terminal 12 and the drivers 11 for the left ear and the right ear is a noise reducing device section 20 including not only the equalizer circuit 13, the adding circuit 14, and the power amplifier 15 but also a microphone 21 as acoustic-to-electric converting means, a microphone amplifier (hereinafter referred to simply as a mike amplifier) 22, a filter circuit 23 for noise reduction, a memory 24, a memory controller 25, an operating unit 26 and the like to be described later.

Though not shown in the figure, connections between the noise reducing device section 20 and the driver 11, the microphone 21, and a headphone plug forming the audio signal input terminal 12 are made by a connecting cable. References 20*a*, 20*b*, and 20*c* denote a connecting terminal part at which the connecting cables are connected to the noise reducing device section 20.

The first embodiment of FIG. 1 reduces noise coming from a noise source 3 outside the headphone casing 2 into a music listening position of the listener 1 within the headphone casing 2 in a music listening environment of the listener 1 by the feedback system, so that music can be listened to in a good environment.

In the noise reducing system of the feedback type, noise at an acoustic synthesis position (noise canceling point Pc) at which noise and the acoustically reproduced sound of a noise reducing audio signal are synthesized, the acoustic synthesis position being the music listening position of the listener 1, is collected by a microphone.

Therefore, in the first embodiment, the microphone 21 for collecting noise is provided at the noise canceling point Pc inside the headphone casing (housing unit) 2. The position of the microphone 21 is a control point. Thus, in consideration of noise attenuating effect, the noise canceling point Pc is normally disposed at a position close to the ear, that is, a position in front of the diaphragm of the driver 11. The microphone 21 is provided at this position.

An opposite phase component of the noise collected by the microphone is generated as a noise reducing audio signal by a noise reducing audio signal generating unit. The generated noise reducing audio signal is supplied to the driver 11 to be acoustically reproduced. Thereby the noise coming from the outside into the headphone casing 2 is reduced.

Noise at the noise source 3 and the noise 3' that has come into the headphone casing 2 do not have same characteristics. In the noise reducing system of the feedback type, however, the noise 3' that has come into the headphone casing 2, that is, the noise 3' to be reduced is collected by the microphone 21.

Thus, in the feedback system, it suffices for the noise reducing audio signal generating unit to generate the opposite phase component of the noise 3' so as to cancel the noise 3' collected at the noise canceling point Pc by the microphone 21.

The present embodiment uses the digital filter circuit 23 as the noise reducing audio signal generating unit of the feedback system. In the present embodiment, the noise reducing audio signal is generated by the feedback system, and therefore the digital filter circuit 23 will hereinafter be referred to as an FB filter circuit 23.

The FB filter circuit 23 includes a DSP (Digital Signal Processor) 232, an A/D converter circuit 231 provided in a stage preceding the DSP 232, and a D/A converter circuit 233 provided in a stage succeeding the DSP 232.

An analog audio signal obtained by collecting sound by the microphone 21 is supplied to the FB filter circuit 23 via the mike amplifier 22. The analog audio signal is converted into a digital audio signal by the A/D converter circuit 231. The digital audio signal is supplied to the DSP 232.

The DSP 232 includes a digital filter for generating a digital noise reducing audio signal of the feedback system. The digital filter generates the digital noise reducing audio signal having a characteristic corresponding to a filter coefficient as a parameter set in the digital filter from the digital audio signal input to the digital filter. In the present embodiment, the filter coefficient set in the digital filter of the DSP 232 is supplied from the memory 24 through the memory controller 25.

In the present embodiment, the memory 24 stores filter coefficients as a plurality of (plurality of sets of) parameters as later described in order to be able to reduce noise in a plurality of various different noise environments by the noise reducing audio signal of the feedback system which signal is generated by the digital filter of the DSP 232.

The memory controller 25 reads one particular filter coefficient (one particular set of filter coefficients) from the memory 24, and sets the filter coefficient (the filter coefficient set) in the digital filter of the DSP 232.

The memory controller 25 in the present embodiment is supplied with an operating output signal of the operating unit 26. According to the operating output signal from the operating unit 26, the memory controller 25 selects and reads one particular filter coefficient (one particular set of filter coefficients) from the memory 24, and sets the filter coefficient (the filter coefficient set) in the digital filter of the DSP 232.

Then, the digital filter of the DSP 232 generates the digital noise reducing audio signal corresponding to the filter coefficient selectively read from the memory 24 via the memory controller 25 and set in the digital filter of the DSP 232 as described above.

The digital noise reducing audio signal generated by the DSP 232 is then converted into an analog noise reducing audio signal in the D/A converter circuit 233. This analog noise reducing audio signal is supplied as an output signal of the FB filter circuit 23 to the adding circuit 14.

An input audio signal (music signal or the like) S that the listener 1 desires to listen to by headphone is supplied to the adding circuit 14 via the audio signal input terminal 12 and the equalizer circuit 13. The equalizer circuit 13 corrects the sound characteristic of the input audio signal.

An audio signal as a result of addition by the adding circuit 14 is supplied to the driver 11 via the power amplifier 15 to be acoustically reproduced. The sound acoustically reproduced and emitted by the driver 11 includes an acoustically reproduced component based on the noise reducing audio signal generated in the FB filter circuit 23. The acoustically reproduced component based on the noise reducing audio signal, the acoustically reproduced component being included in the sound acoustically reproduced and emitted by the driver 11, and the noise 3' are acoustically synthesized, whereby the noise 3' is reduced (cancelled) at the noise canceling point Pc.

The noise reducing operation of the noise reducing device of the feedback type described above will be described using transfer functions with reference to FIG. 2.

Figure 2:
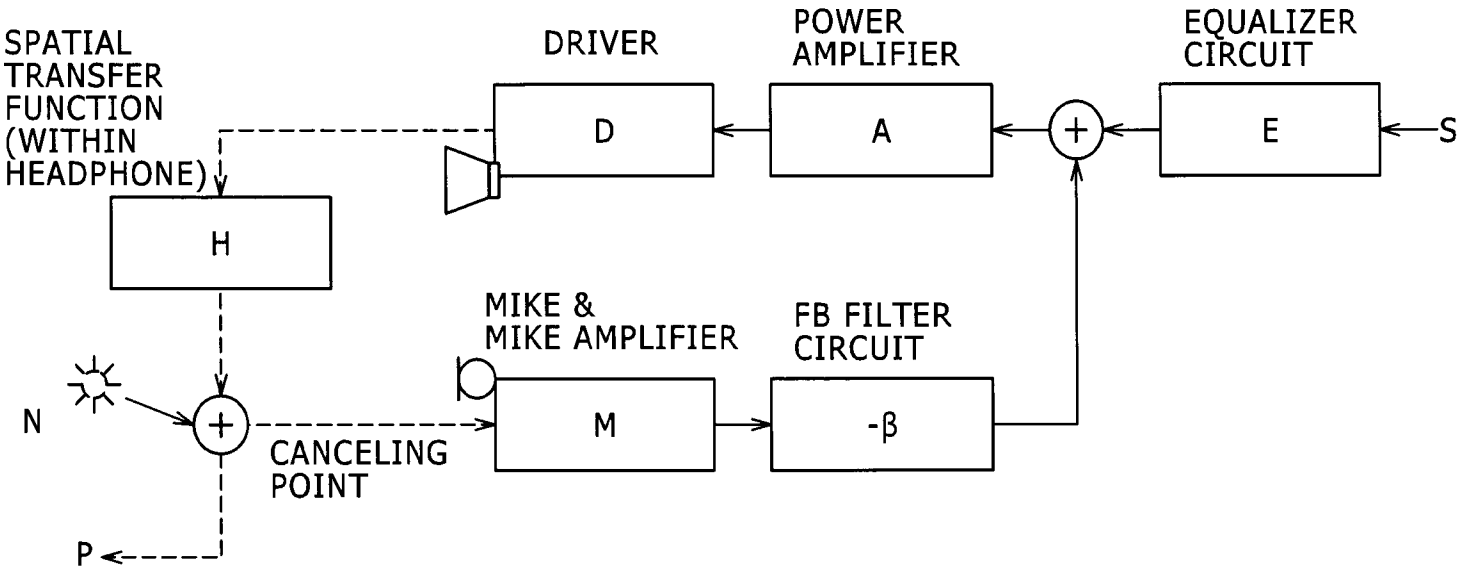
FIG. 2 is a diagram showing the configuration of the noise reducing device according to the first embodiment of the present invention using transfer functions.

FIG. 2 is a block diagram representing parts using transfer functions of the parts in correspondence with the block diagram of FIG. 1. In FIG. 2, A is the transfer function of the power amplifier 15, D is the transfer function of the driver 11, M is the transfer function corresponding to a part of the microphone 21 and the mike amplifier 22, and $-\beta$ is the transfer function of a filter designed for feedback. H is the transfer function of a space from the driver 11 to the microphone 21, and E is the transfer function of the equalizer 13 applied to an audio signal S to be listened to. Suppose that each of the above-described transfer functions is expressed by complex representation.

In FIG. 2, N is the noise entering the vicinity of the position of the microphone 21 within the headphone casing 2 from the external noise source, and P is sound pressure reaching the ear of the listener 1. Incidentally, the external noise is transmitted to the inside of the headphone casing 2 because the noise leaks as a sound pressure from a crack of an ear pad portion, or the headphone casing 2 is subjected to a sound pressure and thereby vibrates, resulting in the sound being transmitted to the inside of the headphone casing 2, for example.

When represented as in FIG. 2, the blocks of FIG. 2 can be expressed by (Equation 1) in FIG. 3. Directing attention to noise N in (Equation 1), the noise N is attenuated to $1/(1+ADHM\beta)$. However, for the system of (Equation 1) to operate stably as a noise canceling mechanism in a frequency band subjected to noise reduction, (Equation 2) in FIG. 3 may need to hold.

Generally, in combination with the absolute value of a product of transfer functions in the noise reducing system of the feedback type being more than one ($1 \ll |ADHM\beta|$), and with Nyquist's stability criterion in a classic control theory, the stability of the system regarding (Equation 2) in FIG. 3 can be interpreted as follows.

Consideration will be given to an "open loop" of the transfer functions ($-ADHM\beta$), the open loop being formed by disconnecting one part in a loop part (loop part from the microphone 21 to the driver 11) related to the noise N in FIG. 2. This open loop has characteristics represented in a Bode diagram of FIG. 4.

Figure 4:
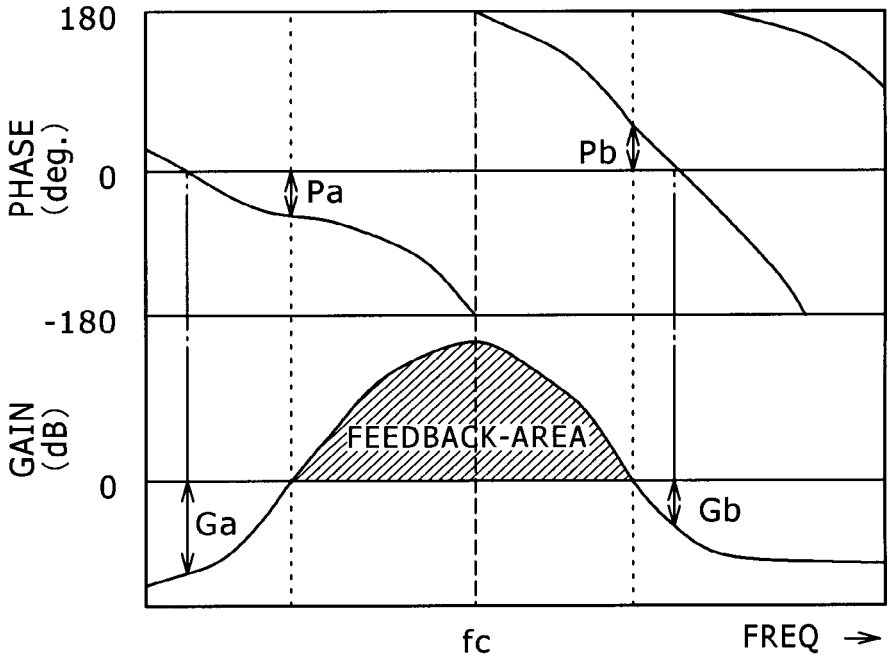
FIG. 4 is a diagram of assistance in explaining the first embodiment of the noise reducing device according to the present invention.

When this open loop is considered, from Nyquist's stability criterion, two conditions that • gain be lower than 0 dB when a point of a phase of 0 deg. is passed in FIG. 4 and that • a point of a phase of 0 deg. not be included when the gain is 0 dB or higher in FIG. 4 need to be met in order for the above-described (Equation 2) to hold.

When the two conditions are not met, positive feedback is effected in the loop, and oscillation (howling) is caused. In FIG. 4, Pa and Pb denote a phase margin, and Ga and Gb denote a gain margin. When these margins are small, the risk of oscillation is increased depending on individual difference and variations in the wearing of the headphone.

Description will next be made of a case of reproducing necessary sound from the driver of the headphone, in addition to the above-described noise reducing function.

The audio signal S to be listened to in FIG. 2 is a generic name for signals to be primarily reproduced from the driver of the headphone, which signals actually include not only a music signal but also sound of a microphone outside the casing (used as a hearing aid function), an audio signal via a communication (used as a headset), and the like.

Directing attention to the signal S in the above-described (Equation 1), when the equalizer E is set as in (Equation 3) shown in FIG. 3, the sound pressure P is expressed as in (Equation 4) in FIG. 3.

Thus, supposing that the position of the microphone 21 is very close to the position of the ear, because H is the transfer function from the driver 11 to the microphone 21 (ear), and A and D are the transfer functions of the characteristics of the power amplifier 15 and the driver 11, respectively, it is shown that a characteristic similar to an ordinary headphone without a noise reducing function is obtained. Incidentally, at this time, the transfer characteristic E of the equalizer circuit 13 is substantially equal to an open loop characteristic as viewed on a frequency axis.

As described above, with the headphone device of the configuration in FIG. 1, an audio signal to be listened to can be listened to without any problem while noise is reduced. In this case, however, to obtain a sufficient noise reduction effect may require that a filter coefficient corresponding to the characteristic of noise transmitted from the external noise source 3 to the inside of the headphone casing 2 be set in the digital filter formed by the DSP 232.

As described above, there are various noise environments in which noise occurs, and the frequency characteristics and the phase characteristics of the noise correspond to the respective noise environments. Therefore a sufficient noise reduction effect cannot be expected to be obtained with a single filter coefficient in all the noise environments.

Accordingly, in the present embodiment, as described above, a plurality of (a plurality of sets of) filter coefficients corresponding to the various noise environments are prepared by being stored in advance in the memory 24. A filter coefficient considered to be appropriate is selected and read from the plurality of filter coefficients, and then set in the digital filter formed by the DSP 232 in the FB filter circuit 23.

It is desirable that noise be collected in each of the various noise environments and an appropriate filter coefficient to be set in the digital filter which filter coefficient can reduce (cancel) the noise be calculated and stored in the memory 24 in advance. For example, noise is collected in various noise environments such as a platform in a railway station, an airport, the inside of a train running on the ground, the inside of a subway train, the bustle of town, the inside of a large store, and the like. Appropriate filter coefficients that can reduce (cancel) the noise are calculated and stored in the memory 24 in advance.

In the first embodiment, a user manually selects an appropriate filter coefficient from the plurality of (plurality of sets of) filter coefficients stored in the memory 24. Thus, the operating unit 26 to be operated by the user is connected to the memory controller 25.

The operating unit 26 in the present embodiment has for example a non-locking type push switch as a filter coefficient changing operating device. Each time the listener presses the push switch, the memory controller 25 changes a filter coefficient set read from the memory 24, and supplies the changed filter coefficient set to the FB filter circuit 23.

Figure 5:
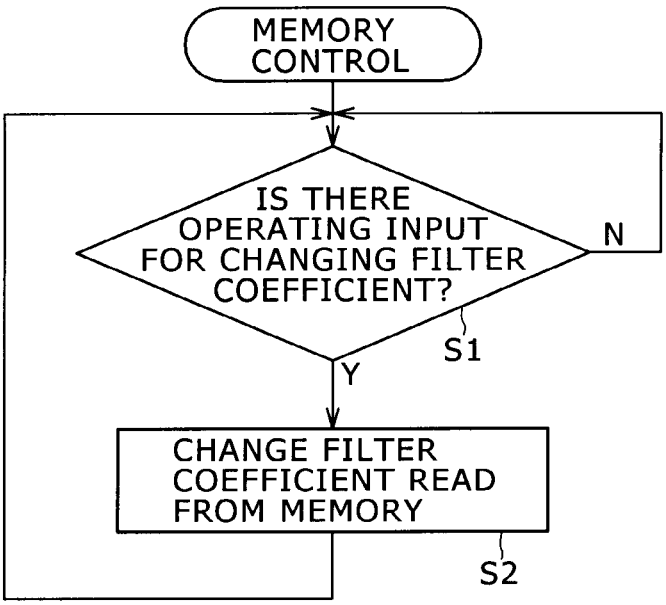
FIG. 5 is a flowchart of assistance in explaining operation of principal parts in the embodiment of the noise reducing device according to the present invention.

FIG. 5 is a flowchart of memory readout control in the memory controller 25 in this case. The memory controller 25 monitors an operating signal from the operating unit 26 to determine whether or not the push switch has been pressed to give an operating instruction to change a filter coefficient (step S1).

When it is determined in step S1 that the filter coefficient changing operating instruction is not given, the memory controller 25 repeats step S1 and waits for the filter coefficient changing operating instruction. When it is determined in step S1 that the filter coefficient changing operating instruction is given, the memory controller 25 changes the filter coefficient set read from the memory 24 to a next filter coefficient different from the filter coefficient thus far, and then supplies the next filter coefficient to the FB filter circuit 23 (step S2). The process thereafter returns to step S1.

In this case, the memory controller 25 determines, in advance, a readout sequence for the plurality of (plurality of sets of) filter coefficients stored in the memory 24, and reads and changes the plurality of filter coefficients in order and cyclically according to the readout sequence when determining that the filter coefficient changing operating instruction is given.

Figure 6:
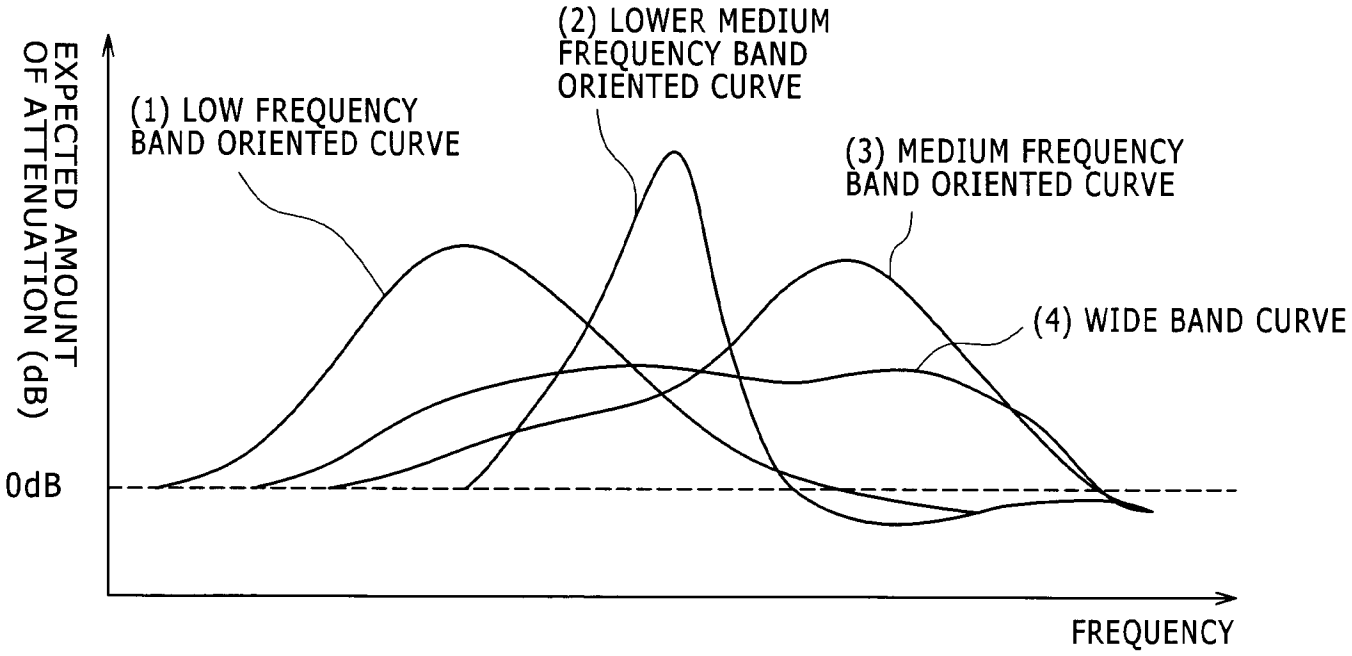
FIG. 6 is a diagram of assistance in explaining the embodiment of the noise reducing device according to the present invention.

Suppose that for example sets of parameters, that is, sets of filter coefficients that can provide four kinds of noise reduction effects as represented by "noise attenuating curves (noise attenuating characteristics)" shown in FIG. 6 are written in the memory 24. In the example of FIG. 6, for four kinds of noise characteristics in cases where noise is distributed mainly in a low-frequency band, a lower-medium-frequency band, a medium-frequency band, and a wide band, respectively, the filter coefficient that provides a curve characteristic for reducing the noise in each of the cases is stored in the memory 24.

In this case, suppose that the filter coefficient providing a noise reducing characteristic of a low frequency band oriented curve for reducing the noise distributed mainly in the low-frequency band as shown in FIG. 6 is a first filter coefficient, that the filter coefficient providing a noise reducing characteristic of a lower medium frequency band oriented curve for reducing the noise distributed mainly in the lower-medium-frequency band as shown in FIG. 6 is a second filter coefficient, that the filter coefficient providing a noise reducing characteristic of a medium frequency band oriented curve for reducing the noise distributed mainly in the medium-frequency band as shown in FIG. 6 is a third filter coefficient, and that the filter coefficient providing a noise reducing characteristic of a wide band oriented curve for reducing the noise distributed in the wide band as shown in FIG. 6 is a fourth filter coefficient. Then, each time the push switch is pressed to give the filter coefficient changing operating instruction, the filter coefficient read from the memory 24 is changed from the first filter coefficient to the second filter coefficient to the third filter coefficient to the fourth filter coefficient to the first filter coefficient . . . , for example.

Thus changing the filter coefficient, the listener 1 checks the noise reduction effect with his/her own ears, and stops pressing the push switch after the filter coefficient with which the listener feels that a sufficient noise reduction effect is obtained is read. Then, the memory controller 25 thereafter continues reading the filter coefficient read at this time, and is controlled to be in a state of reading the filter coefficient selected by the user.

In this case, for the listener to check the noise reduction effect more surely, it is better for the listener to check the noise reduction effect in an environment in which reproduced sound based on the audio signal S is not emitted from the driver 11. Methods adoptable for this include a method of allowing the listener to check the noise reduction effect while operating the operating unit 26 in an environment in which the audio signal S is not input and a method of muting the audio signal to the adding circuit 14 for a predetermined time, which is more or less sufficient to check the noise reduction effect, from the pressing of the push switch of the operating unit 26 when the audio signal S is being input and reproduced.

Incidentally, the above-described example of FIG. 6 corresponds to a case where states in which noise is distributed mainly in four kinds of bands, that is, a low-frequency band, a lower-medium-frequency band, a medium-frequency band, and a wide band are assumed, filter coefficients are set so as to provide curve characteristics for reducing the noise in the respective cases, and then the filter coefficients are stored in the memory 24, rather than a case where noise in each noise environment is actually measured and then the filter coefficient corresponding thereto is set, as described above.

Even with the simply set filter coefficients, the noise reducing device according to the present embodiment can select a filter coefficient suitable for each noise environment. Therefore a better noise reduction effect can be obtained than in a case where the filter coefficient is set fixedly as in the existing analog filter system.

Incidentally, the memory controller 25 in the above-described embodiment can also be formed within the DSP 232.

Though no reference has been made to the equalizer characteristic of the equalizer circuit 13 in the above description, in the case of the noise reducing device of the feedback type, when the filter coefficient of the digital filter is changed and thereby the noise reducing curve is changed, the equalizer characteristic may need to be changed in response to the changing of the filter coefficient of the digital filter because an effect corresponding to the frequency curve of the noise reduction effect is produced on the externally input audio signal S to be listened to.

Accordingly, for example, a parameter for changing the equalizer characteristic of the equalizer circuit 13 is stored in the memory 24 in correspondence with each of the plurality of filter coefficients of the digital filter. The memory controller 25 supplies the equalizer circuit 13 with a parameter in response to the changing of the filter coefficient, and thus the equalizer characteristic of the equalizer circuit 13 is changed.

Incidentally, the equalizer circuit 13 may be formed as a constitution of a digital equalizer circuit within the DSP 232. In this case, the audio signal S is converted into a digital signal, and the digital signal is supplied to the equalizer circuit within the DSP 232. Then, it suffices for the memory controller 25 to read a parameter from the memory 24 in response to a change of the filter coefficient of the digital filter, and supply the parameter to the digital equalizer circuit to thus change the equalizer characteristic of the digital equalizer circuit.

Second Embodiment (Noise Reducing Device of Feed Forward Type)

Figure 7:
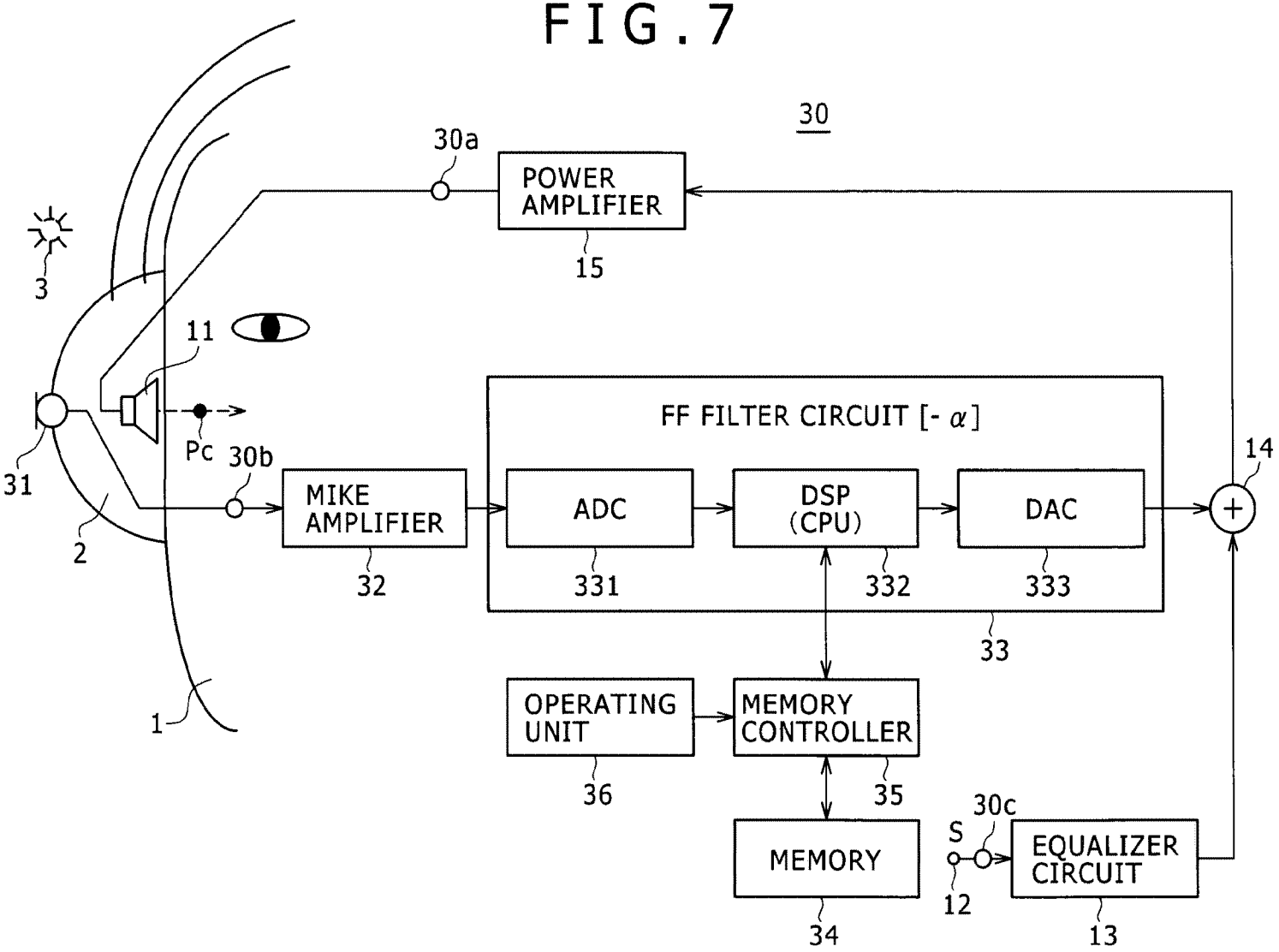
FIG. 7 is a block diagram showing an example of a headphone device to which a second embodiment of the noise reducing device according to the present invention is applied.

FIG. 7 shows an example of configuration of an embodiment of a headphone device to which an embodiment of the noise reducing device according to the present invention is applied. FIG. 7 is a block diagram representing a case where a feed forward system is adopted in place of the feedback system of FIG. 1. In FIG. 7, the same parts as in FIG. 1 are identified by the same reference numerals.

A noise reducing device section 30 includes a microphone 31 as acoustic-to-electric converting means, a mike amplifier 32, a filter circuit 33 for noise reduction, a memory 34, a memory controller 35, an operating unit 36, and the like.

As in the noise reducing device section 20 of the feedback type as described above, the noise reducing device section 30 is connected to a driver 11, the microphone 31, and a headphone plug forming an audio signal input terminal 12 by connecting cables. References 30*a*, 30*b*, and 30*c* denote a connecting terminal part at which the connecting cables are connected to the noise reducing device section 30.

The second embodiment reduces noise coming from a noise source 3 outside a headphone casing 2 into a music listening position of a listener 1 within the headphone casing 2 in a music listening environment of the listener 1 by the feed forward system, so that music can be listened to in a good environment.

The noise reducing system of the feed forward type basically has the microphone 31 located outside the headphone casing 2 as shown in FIG. 7. A noise 3 collected by the microphone 31 is subjected to an appropriate filtering process to generate a noise reducing audio signal. The generated noise reducing audio signal is acoustically reproduced by the driver 11 within the headphone casing 2, whereby noise (noise 3') is cancelled at a position close to the ear of the listener 1.

The noise 3 collected by the microphone 31 and the noise 3' within the headphone casing 2 have different characteristics corresponding to a difference between spatial positions of the two noises (including a difference between the outside and the inside of the headphone casing 2). Thus, in the feed forward system, the noise reducing audio signal is generated taking into account a difference between spatial transfer functions of the noise from the noise source 3 which noise is collected by the microphone 31 and the noise 3' at a noise canceling point Pc.

In the present embodiment, a digital filter circuit 33 is used as a noise reducing audio signal generating unit of the feed forward system. In the present embodiment, the noise reducing audio signal is generated by the feed forward system, and therefore the digital filter circuit 33 will hereinafter be referred to as an FF filter circuit 33.

In exactly the same manner as the FB filter circuit 23, the FF filter circuit 33 includes a DSP (Digital Signal Processor) 332, an A/D converter circuit 331 provided in a stage preceding the DSP 332, and a D/A converter circuit 333 provided in a stage succeeding the DSP 332.

As shown in FIG. 7, an analog audio signal obtained by collecting sound by the microphone 31 is supplied to the FF filter circuit 33 via the mike amplifier 32. The analog audio signal is converted into a digital audio signal by the A/D converter circuit 331. The digital audio signal is supplied to the DSP 332.

The DSP 332 includes a digital filter for generating a digital noise reducing audio signal of the feed forward system. The digital filter generates the digital noise reducing audio signal having a characteristic corresponding to a filter coefficient as a parameter set in the digital filter from the digital audio signal input to the digital filter. In the present embodiment, the filter coefficient set in the digital filter of the DSP 332 is supplied from the memory 34 through the memory controller 35.

In the present embodiment, the memory 34 stores filter coefficients as a plurality of (plurality of sets of) parameters as later described in order to be able to reduce noise in a plurality of various different noise environments by the noise reducing audio signal of the feed forward system which signal is generated by the digital filter of the DSP 332.

The memory controller 35 reads one particular filter coefficient (one particular set of filter coefficients) from the memory 34, and sets the filter coefficient (the filter coefficient set) in the digital filter of the DSP 332.

The memory controller 35 in the present embodiment is supplied with an operating output signal of the operating unit 36. According to the operating output signal from the operating unit 36, the memory controller 35 selects and reads one particular filter coefficient (one particular set of filter coefficients) from the memory 34, and sets the filter coefficient (the filter coefficient set) in the digital filter of the DSP 332.

Then, the digital filter of the DSP 332 generates the digital noise reducing audio signal corresponding to the filter coefficient selectively read from the memory 34 via the memory controller 35 and set in the digital filter of the DSP 332 as described above.

The digital noise reducing audio signal generated by the DSP 332 is then converted into an analog noise reducing audio signal in the D/A converter circuit 333. This analog noise reducing audio signal is supplied as an output signal of the FF filter circuit 33 to an adding circuit 14.

An input audio signal (music signal or the like) S that the listener 1 desires to listen to by headphone is supplied to the adding circuit 14 via the audio signal input terminal 12 and an equalizer circuit 13. The equalizer circuit 13 corrects the sound characteristic of the input audio signal.

An audio signal as a result of addition by the adding circuit 14 is supplied to the driver 11 via a power amplifier 15 to be acoustically reproduced. The sound acoustically reproduced and emitted by the driver 11 includes an acoustically reproduced component based on the noise reducing audio signal generated in the FF filter circuit 33. The acoustically reproduced component based on the noise reducing audio signal, the acoustically reproduced component being included in the sound acoustically reproduced and emitted by the driver 11, and the noise 3' are acoustically synthesized, whereby the noise 3' is reduced (cancelled) at the noise canceling point Pc.

The parts of the memory 34, the memory controller 35, and the operating unit 36 in the second embodiment are formed in exactly the same manner as the memory 24, the memory controller 25, and the operating unit 26 in the first embodiment. Each time a push switch of the operating unit 36 is pressed, a filter coefficient corresponding to a different noise environment is read from the memory 34 in order and cyclically, and then supplied to the FF filter circuit 33.

In addition, the configuration of the FF filter circuit 33 is exactly the same as that of the FB filter circuit 23. However, the first embodiment and the second embodiment are different from each other in that the filter coefficient supplied to the digital filter formed by the DSP 232 in the first embodiment is that of the feedback system, while the filter coefficient supplied to the digital filter formed by the DSP 332 in the second embodiment is that of the feed forward system.

Figure 8:
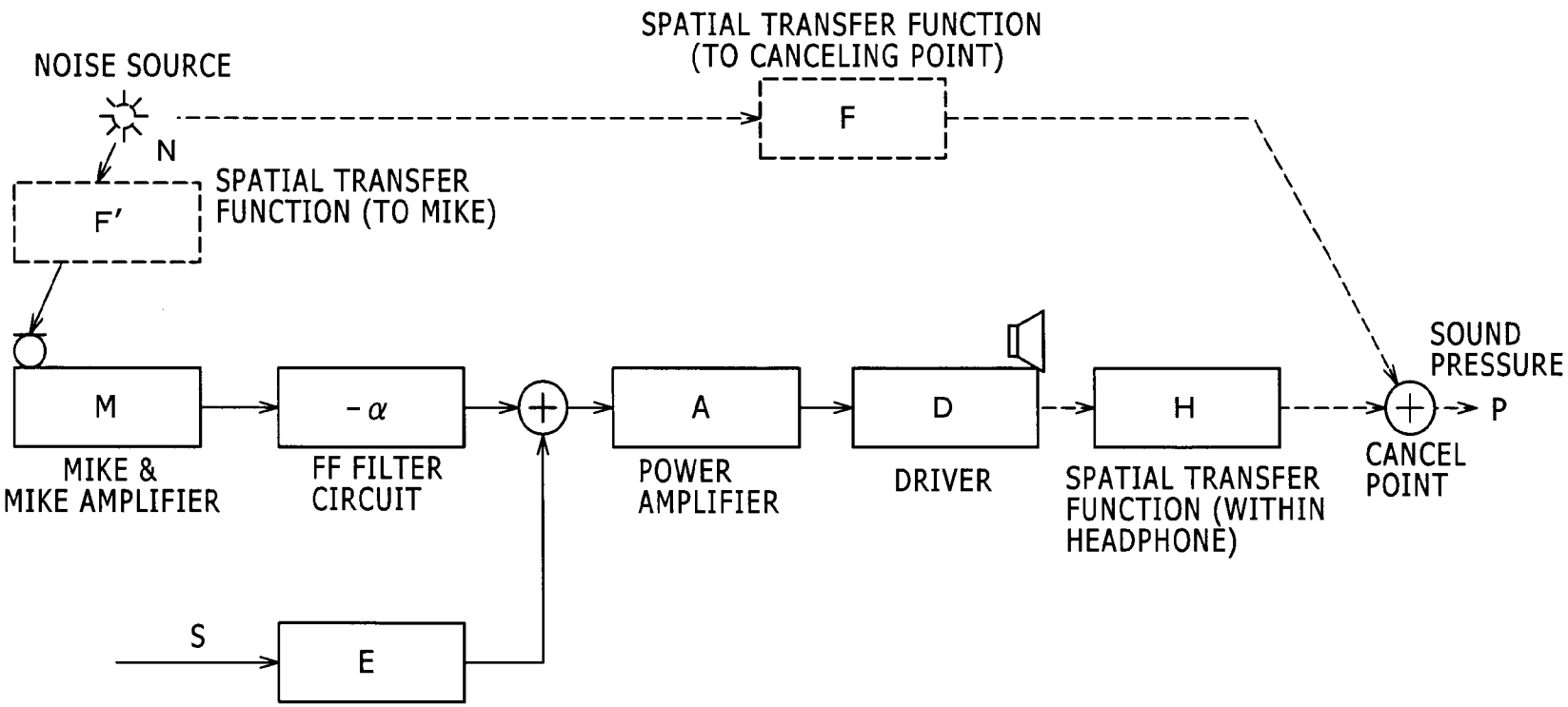
FIG. 8 is a diagram showing the configuration of the second embodiment of the noise reducing device according to the present invention using transfer functions.

The noise reducing operation of the noise reducing device of the feed forward type will next be described using transfer functions with reference to FIG. 8. FIG. 8 is a block diagram representing parts using transfer functions of the parts in correspondence with the block diagram of FIG. 7.

In FIG. 8, A is the transfer function of the power amplifier 15, D is the transfer function of the driver 11, M is the transfer function corresponding to a part of the microphone 31 and the mike amplifier 32, and $-\alpha$ is the transfer function of a filter designed for feed forward. H is the transfer function of a space from the driver 11 to the noise canceling point Pc, and E is the transfer function of the equalizer 13 applied to an audio signal S to be listened to. F is a transfer function from the position of noise N of the external noise source 3 to the position of the noise canceling point Pc in the ear of the listener.

When represented as in FIG. 8, the blocks of FIG. 8 can be expressed by (Equation 5) in FIG. 3. Incidentally, F' is a transfer function from the noise source to the position of the mike. Suppose that each of the above-described transfer functions is expressed by complex representation.

Considering an ideal state and supposing that the transfer function F can be represented as in (Equation 6) in FIG. 3, (Equation 5) in FIG. 3 can be represented by (Equation 7) in FIG. 3. It is thus shown that the noise is cancelled, and only the music signal (or the desired music signal or the like to be listened to) S is left, so that the same sound as in an ordinary headphone operation can be listened to. A sound pressure P at this time is expressed as in (Equation 7) in FIG. 3.

In actuality, however, it is difficult to configure a perfect filter having a transfer function such that (Equation 6) in FIG. 3 holds perfectly. As far as a medium-frequency band and a high-frequency band in particular are concerned, there are great individual differences in manner of wearing the headphone and shape of the ear, and characteristics are changed depending on the position of the noise and the position of the mike, for example. Thus, in general, as far as the medium-frequency band and the high-frequency band are concerned, the active noise reducing process is not performed, and passive sound insulation is often performed by the headphone casing 2.

Incidentally, (Equation 6) in FIG. 3 indicates that, as is obvious from the equation, the transfer functions from the noise source to the position of the ear are imitated in electric circuitry including the transfer function $\alpha$ of the digital filter.

Incidentally, the noise canceling point Pc in the feed forward type of the second embodiment can be set at an arbitrary ear position of the listener as shown in FIG. 7, unlike the feedback type of the first embodiment shown in FIG. 1.

In a normal case, however, $\alpha$ is fixed and determined aiming at some target characteristic in a design stage.

Figure 9:
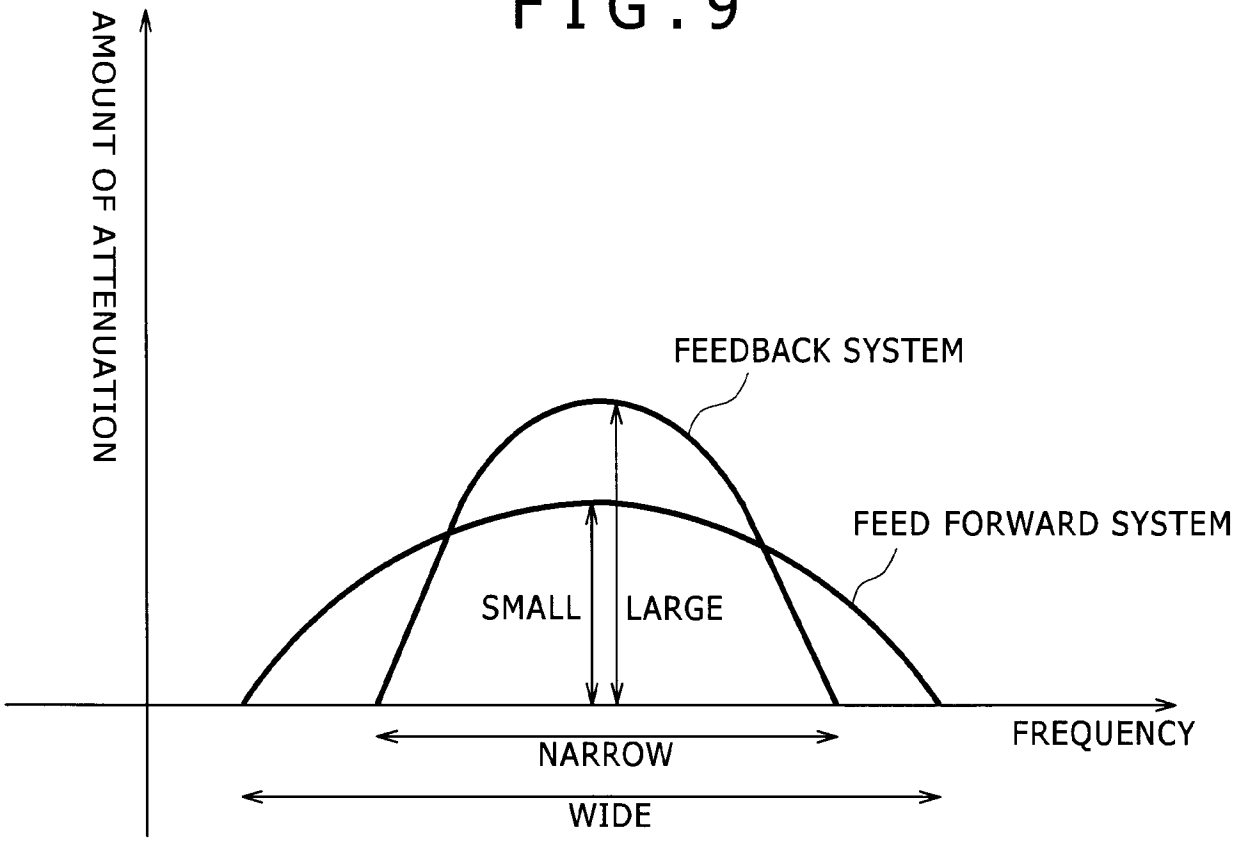
FIG. 9 is a diagram of assistance in explaining attenuating characteristics of a noise reducing system of a feedback type and a noise reducing system of a feed forward type.

Because of differences between the shapes of ears of people, a sufficient noise reduction effect cannot be obtained, or an addition of a noise component in a non-opposite phase can cause a phenomenon of occurrence of strange sound, for example. In general, as shown in FIG. 9, with the feed forward system of the second embodiment, there is a small possibility of oscillation and thus high stability is obtained, but it is difficult to obtain a sufficient amount of attenuation. On the other hand, with the feedback system of the first embodiment, a large amount of attenuation can be expected, but attention may need to be paid to the stability of the system.

Incidentally, the memory controller 35 in the above-described embodiment may be formed within the DSP 332. It is also possible to form the equalizer circuit 13 within the DSP 332, convert the audio signal S into a digital signal, and supply the digital signal to the equalizer circuit within the DSP 332.

Third Embodiment and Fourth Embodiment

In the first embodiment and the second embodiment described above, the filter circuit is digitized, and a plurality of kinds of filter coefficients are prepared in the memory. As required, an appropriate filter coefficient can be selected from the plurality of kinds of filter coefficients and then set in the digital filter.

However, the digitized FB filter circuit 23 and the digitized FF filter circuit 33 have a problem of delay in the A/D converter circuits 231 and 331 and the D/A converter circuits 233 and 333. This problem of delay will be described below with reference to the noise reducing system of the feedback type.

For example, when an A/D converter circuit and a D/A converter circuit having a sampling frequency Fs of 48 kHz are used as a common example, supposing that an amount of delay caused within the A/D converter circuit and the D/A converter circuit is 20 samples in each of the A/D converter circuit and the D/A converter circuit, a delay of a total of 40 samples is included in the block of the FB filter circuit 23 in addition to an operation delay in the DSP. As a result, the delay is applied as a delay of an open loop to the whole of the system.

Figure 10A:
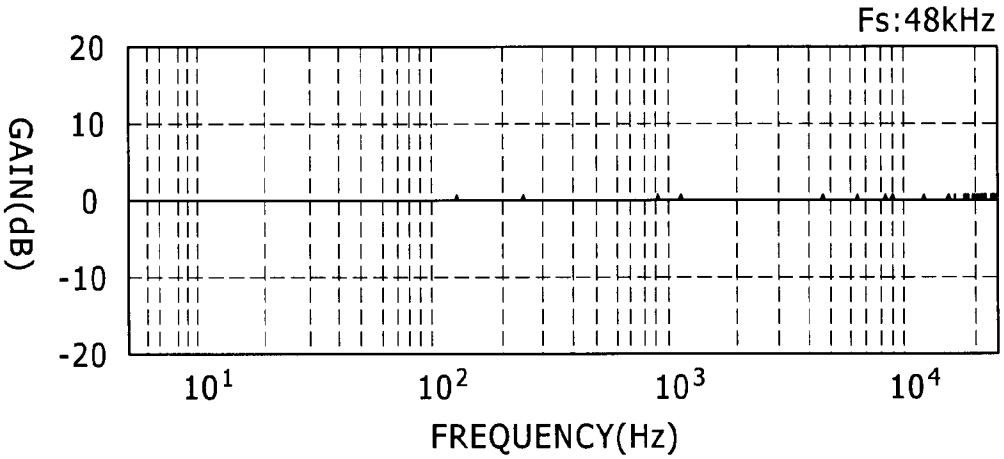
FIGS. 10A and 10B are diagrams of assistance in explaining a third embodiment and a fourth embodiment.
Figure 10B:
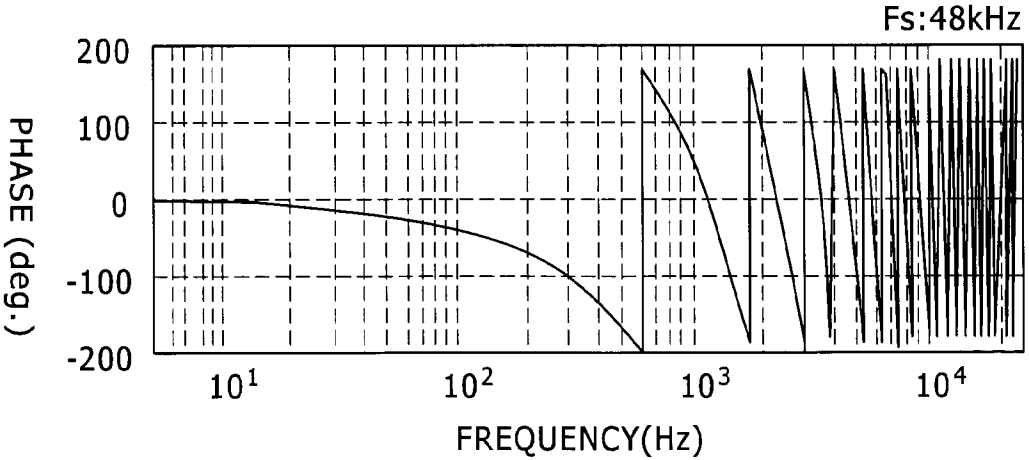
Figure 11A:
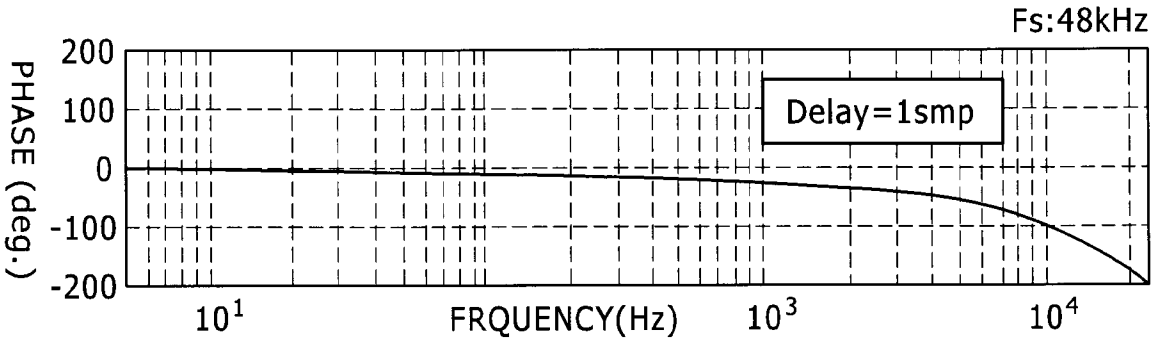
FIGS. 11A, 11B, and 11C are diagrams of assistance in explaining the third embodiment and the fourth embodiment.
Figure 11B:
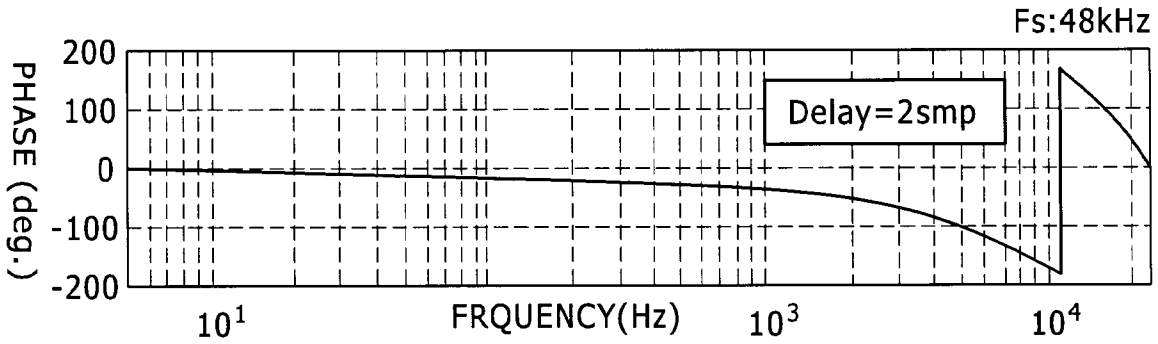
Figure 11C:
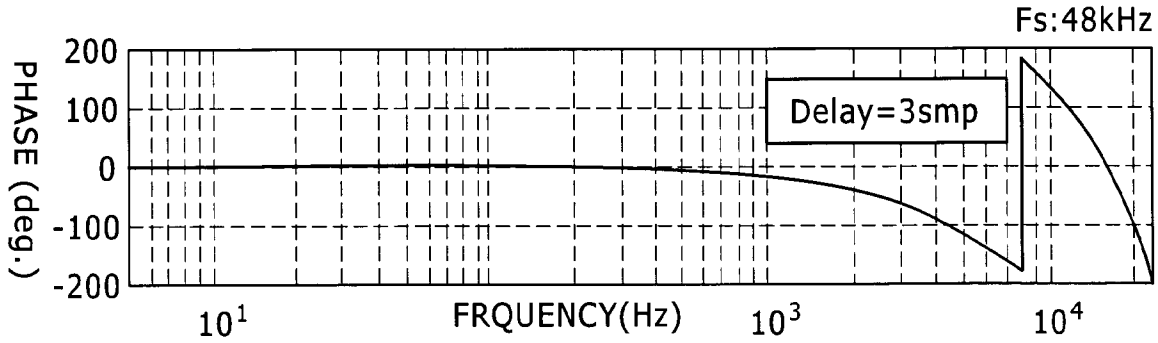

Specifically, a gain and a phase corresponding to the delay of 40 samples at the sampling frequency of 48 kHz are shown in FIG. 10A. A phase rotation starts at a few ten Hz, and the phase is rotated greatly up to a frequency of Fs/2 (24 kHz). This can be easily understood on realizing that, as shown in FIGS. 11A, 11B, and 11C, a delay of one sample at the sampling frequency of 48 kHz corresponds to a delay of 180 deg. ($\pi$) at the frequency of Fs/2, and similarly delays of two samples and three samples correspond to delays of $2\pi$ and $3\pi$.

Figure 12A:
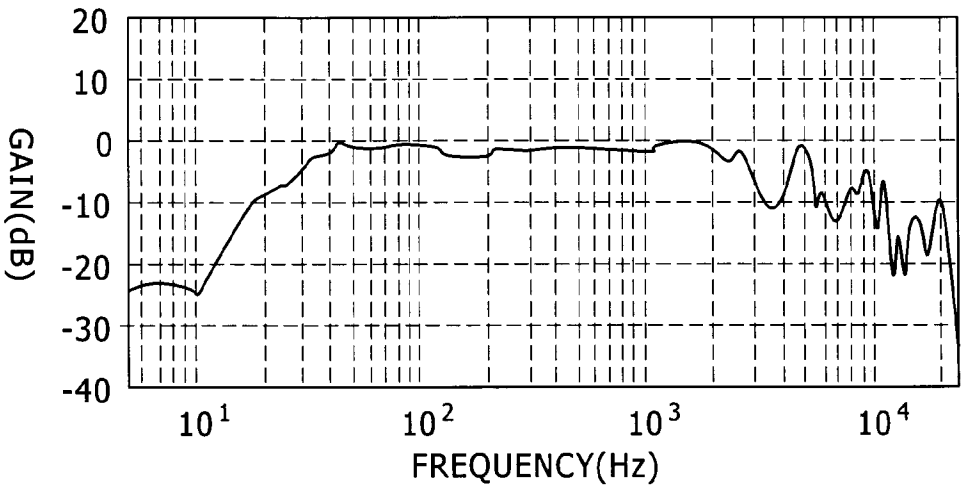
FIGS. 12A and 12B are diagrams of assistance in explaining the third embodiment and the fourth embodiment.
Figure 12B:
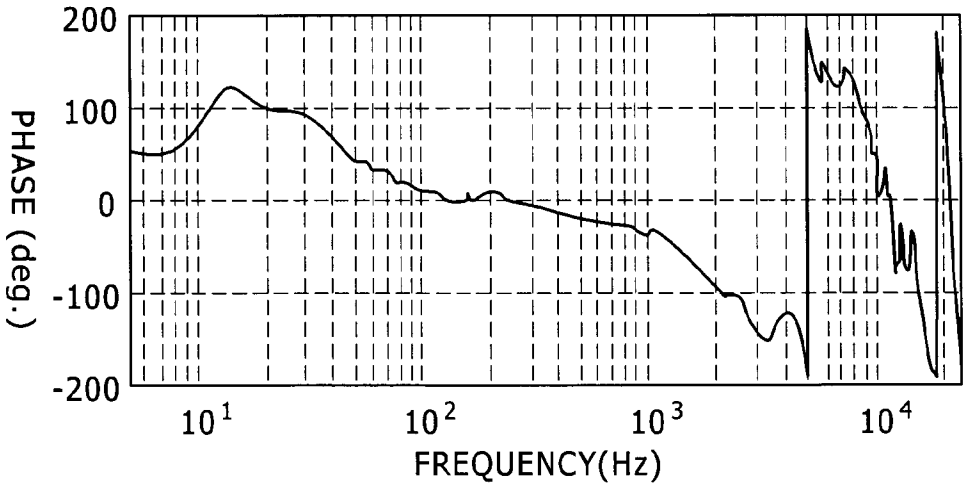

FIGS. 12A and 12B show measurements of a transfer function from the position of the driver 11 to the microphone 21 in the headphone configuration of an actual noise reducing system supposing a feedback constitution. It is shown that in this case, the microphone 21 is disposed in the vicinity of the front surface of the diaphragm of the driver 11, and that because of a short distance between the microphone 21 and the driver 11, a relatively small phase rotation occurs.

The transfer function shown in FIGS. 12A and 12B corresponds to ADHM in (Equation 1) and (Equation 2). A result of multiplying this and the filter having the characteristic of the transfer function $-\beta$ on a frequency axis constitutes an open loop as it is. The shape of the open loop may need to meet the above-described conditions shown using (Equation 2) and FIG. 4.

Looking at the phase characteristics of FIG. 10A once again shows that starting at 0 deg., one round ($2\pi$) of rotation is made at about 1 kHz. In addition to this, in the ADHM characteristics of FIGS. 12A and 12B, there is a phase delay depending on the distance from the driver 11 to the microphone 21.

In the FB filter circuit 23, the digital filter part formed by the DSP 232 that can be designed freely is connected in series with the delay components in the A/D converter circuit 231 and the D/A converter circuit 233. However, it is basically difficult to design a phase advance filter in the digital filter part in view of causality. While a "partial" phase advance in only a particular band is possible depending on the configuration of filter shape, it may be impossible to create a phase advance circuit for a wide band such as compensates for the phase rotation due to this delay.

Considering this, even when an ideal digital filter of the transfer function $-\beta$ is designed by the DSP 232, in this case, a band in which a noise reduction effect can be obtained by the feedback constitution is limited to about 1 kHz, at which one round of phase rotation is made, and lower. When supposing an open loop incorporating even the ADHM characteristic, and allowing for a phase margin and a gain margin, the amount of attenuation and the attenuating band are further reduced.

Figure 13A:
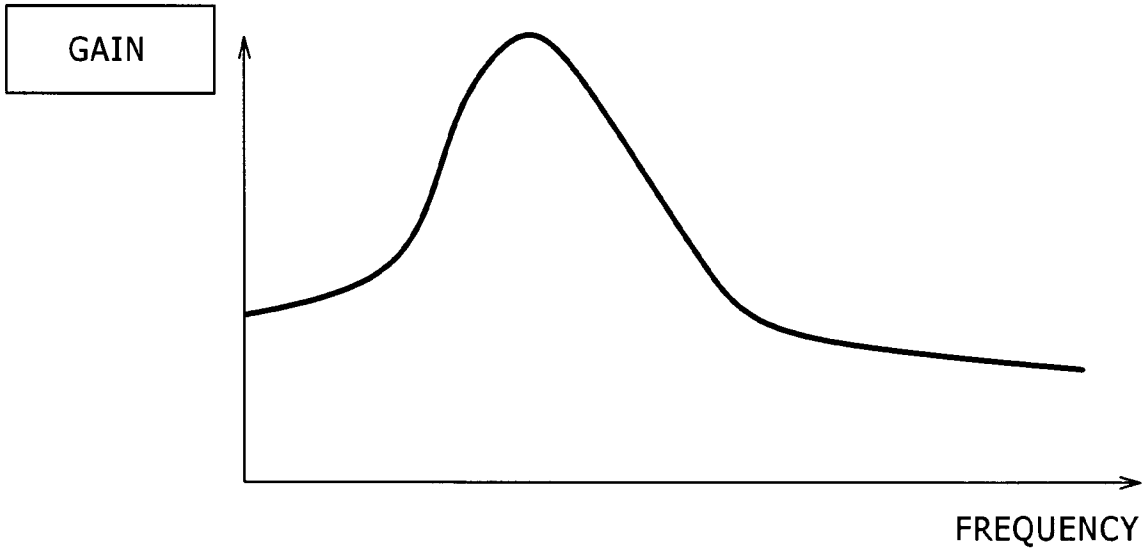
FIGS. 13A and 13B are diagrams of assistance in explaining the third embodiment and the fourth embodiment.
Figure 13B:
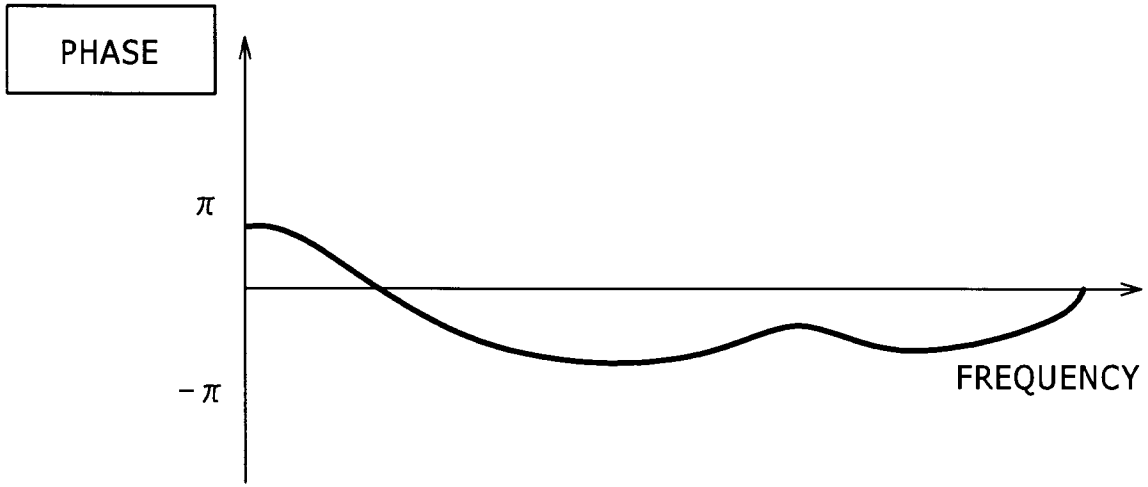

In this sense, it is shown that a desirable $\beta$ characteristic (a phase inversion system within the block of the transfer function $-\beta$) for the characteristics as shown in FIGS. 12A and 12B is such that, as shown in FIGS. 13A and 13B, a gain shape is substantially the shape of a chevron in a band where noise reduction effect is to be produced, while phase rotation does not occur very much (the phase characteristic does not make one rotation in a range from a low-frequency band to a high-frequency band in FIG. 13B). Accordingly, an immediate objective is to design the entire system such that the phase is prevented from making one rotation.

Incidentally, in essence, when the phase rotation is small in a band to be subjected to noise reduction (primarily a low-frequency band), a phase change outside the band is not of concern as long as the gain is not decreased. In general, however, a large amount of phase rotation in a high-frequency band has no small effect on a low-frequency band. It is accordingly an object of the present embodiment to make a design with the phase rotation reduced over a wide band.

In addition, characteristics as shown in FIGS. 13A and 13B can be designed in an analog circuit. In this sense, it is not desirable to greatly impair the noise reduction effect as compared with a case of making a system design with an analog circuit in exchange for advantages of forming the above-described digital filter.

Increasing the sampling frequency reduces the delays in the A/D converter circuit and the D/A converter circuit. A headphone device with the increased sampling frequency is very expensive as a product, but is feasible for military purposes and industrial purposes. However, such a headphone device is too expensive as a product for the general consumer, such as a headphone device for music listening or the like, and is thus less practical.

Accordingly, in the third embodiment and the fourth embodiment, a method is provided which can further increase the noise reduction effect while utilizing the advantages of the digitization in the first embodiment and the second embodiment.

Figure 14:
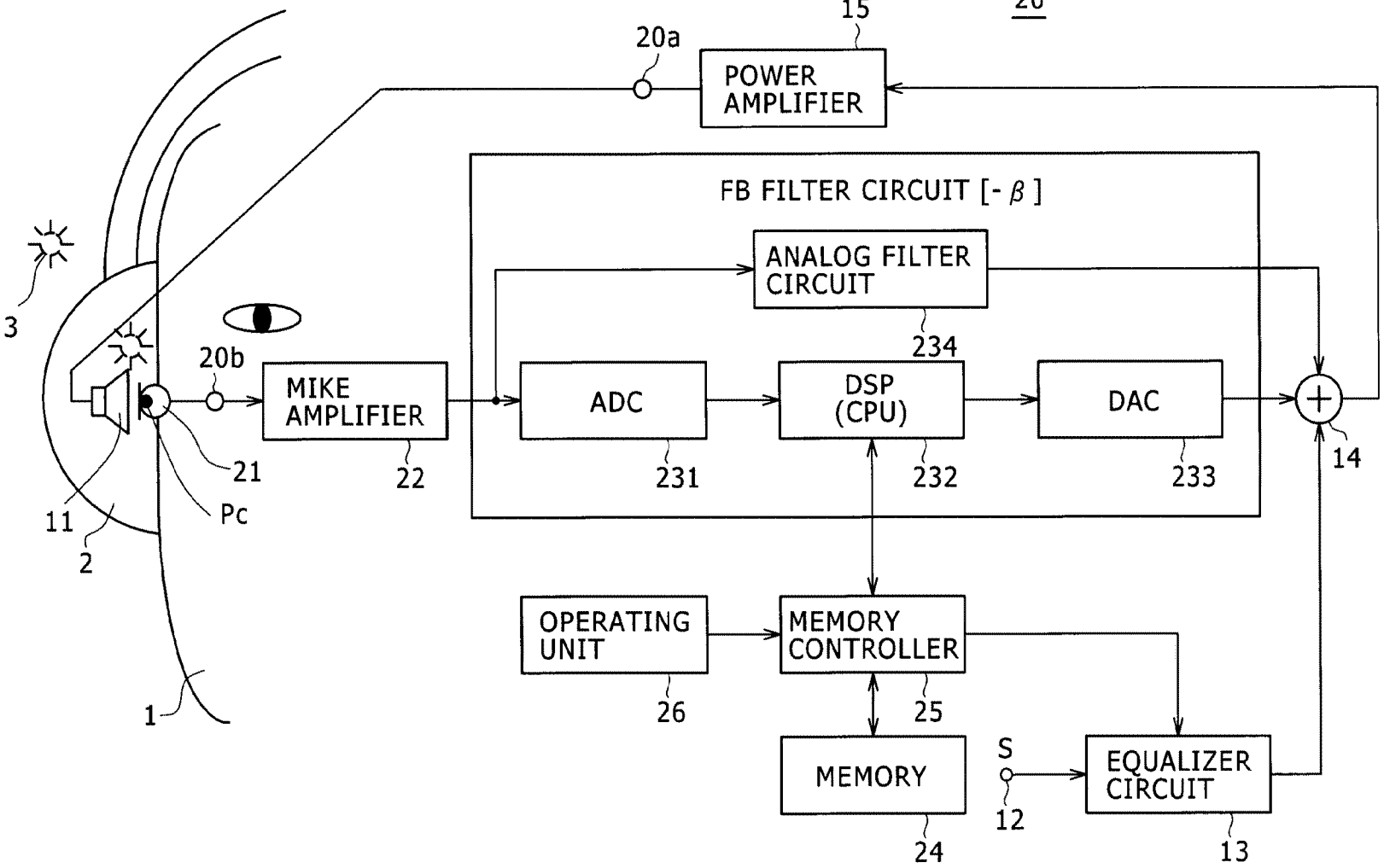
FIG. 14 is a block diagram showing an example of a headphone device to which the third embodiment of the noise reducing device according to the present invention is applied.

FIG. 14 is a block diagram showing a configuration of a headphone device according to the third embodiment. The third embodiment is an improvement over the configuration of the noise reducing device section 20 using the feedback system of the first embodiment.

In the third embodiment, as shown in FIG. 14, an FB filter circuit 23 is formed by providing an analog processing system formed by an analog filter circuit 234 in parallel with a digital processing system formed by an A/D converter circuit 231, a DSP 232, and a D/A converter circuit 233.

An analog noise reducing audio signal generated by the analog filter circuit 234 is added to an adding circuit 14. Otherwise, the configuration of the headphone device according to the third embodiment is exactly the same as the configuration shown in FIG. 1.

Incidentally, the analog filter circuit 234 in FIG. 14 actually includes a case where the analog filter circuit 234 passes through an input audio signal as it is without performing filter processing on the input audio signal, and supplies the input audio signal to the adding circuit 14. In this case, no analog element is present in the analog processing system, and thus a highly reliable system is obtained in terms of variations and stability.

In the FB filter circuit 23 according to the third embodiment, a filter coefficient to be stored in a memory 24 as described above is designed such that a result of adding together two signals after parallel processing by the digital processing system and the analog processing system has a gain characteristic and a phase characteristic as shown in FIGS. 13A and 13B as characteristics of the transfer function $\beta$.

According to the third embodiment, by adding the path of the analog processing system in parallel with the path of the digital processing system, it is possible to alleviate the above-described problems, and perform excellent noise reduction according to various noise environments.

Figure 15:
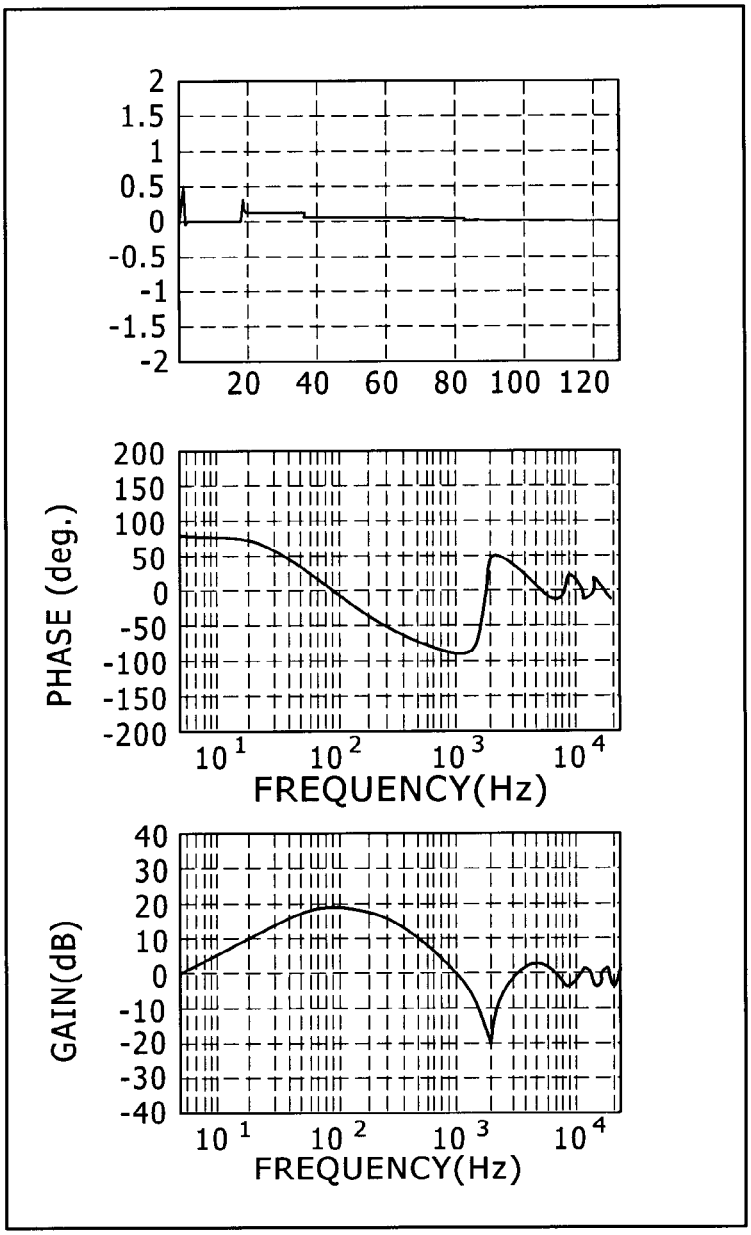
FIG. 15 is a diagram of assistance in explaining characteristics of the third embodiment of the noise reducing device according to the present invention.

Characteristics when the path of the analog processing system (in the case of passing through an input audio signal) is added in parallel with the path of the digital processing system are shown in FIGS. 15A, 15B, and 15C. FIG. 15A shows a head part (up to 128 samples) of impulse response of a transfer function in this example. FIG. 15B shows a phase characteristic. FIG. 15C shows a gain characteristic.

FIG. 15B shows that according to the third embodiment, phase rotation is suppressed by adding the analog path, and that one phase rotation is not made in a range from a low-frequency band to a high-frequency band.

Viewing the characteristics from another aspect, effect of the processing system including the digital filter on a low-frequency characteristic as a main part for noise reduction becomes greater, whereas the characteristic of the quick-response analog path is used effectively for the medium-frequency band and the high-frequency band in which the phase rotation tends to be large due to the delays in the A/D converter circuit and the D/A converter circuit.

Thus, according to the third embodiment, it is possible to provide a noise reducing device and a headphone device that can perform noise reduction adapted to various noise environments without increasing a configuration scale.

While the third embodiment represents a case of performing noise reduction by the feedback system, the third embodiment is similarly applicable to a case of performing noise reduction by the feed forward system of the second embodiment.

Figure 16:
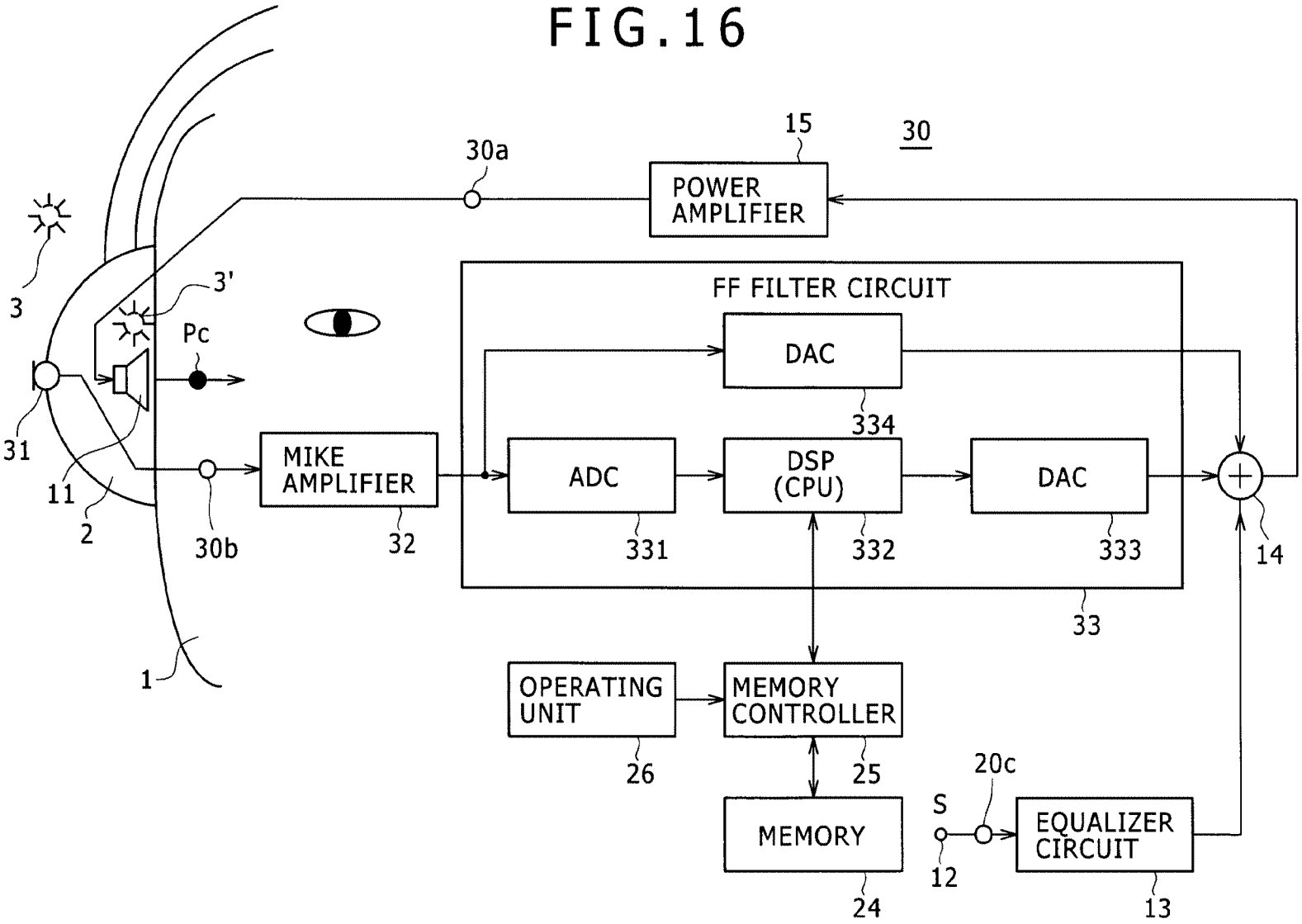
FIG. 16 is a block diagram showing an example of a headphone device to which the fourth embodiment of the noise reducing device according to the present invention is applied.

The fourth embodiment remedies the problems in using the digital filter as described above in the second embodiment performing the noise reduction of the feed forward system. FIG. 16 shows an example of configuration of the fourth embodiment.

Specifically, in the fourth embodiment, an FF filter circuit 33 is formed by providing an analog processing system formed by an analog filter circuit 334 in parallel with a digital processing system formed by an A/D converter circuit 331, a DSP 332, and a D/A converter circuit 333.

An analog noise reducing audio signal generated by the analog filter circuit 334 is added to an adding circuit 14. Otherwise, the configuration of the headphone device according to the fourth embodiment is exactly the same as the configuration shown in FIG. 7.

Incidentally, the analog filter circuit 334 in FIG. 16 includes a case where the analog filter circuit 334 passes through an input audio signal as it is without performing filter processing on the input audio signal, and supplies the input audio signal to the adding circuit 14. In this case, no analog element is present in the analog processing system, and thus a highly reliable system is obtained in terms of variations and stability.

In the FF filter circuit 33 according to the fourth embodiment, a filter coefficient to be stored in a memory 34 as described above is designed such that a result of adding together two signals after parallel processing by the digital processing system and the analog processing system has a gain characteristic and a phase characteristic as shown in FIGS. 13A and 13B as characteristics of the transfer function $\alpha$.

Incidentally, the memory controllers 25 and 35 in the foregoing embodiments can also be formed within the DSPs 232 and 332. It is also possible to form the equalizer circuit 13 within the DSP 232 or 332, convert the audio signal S into a digital signal, and supply the digital signal to the equalizer circuit within the DSP 232 or 332.

Fifth Embodiment

As described above, with the feed forward system of the second embodiment, there is a small possibility of oscillation and thus high stability is obtained, but it is difficult to obtain a sufficient amount of attenuation, whereas with the feedback system of the first embodiment, a large amount of attenuation can be expected, but attention may need to be paid to the stability of the system.

Accordingly, the fifth embodiment provides a noise reducing system having advantages of both systems. That is, as shown in FIG. 17, the fifth embodiment has both of a noise reducing device section 20 of the feedback system and a noise reducing device section 30 of the feed forward system.

Figure 17:
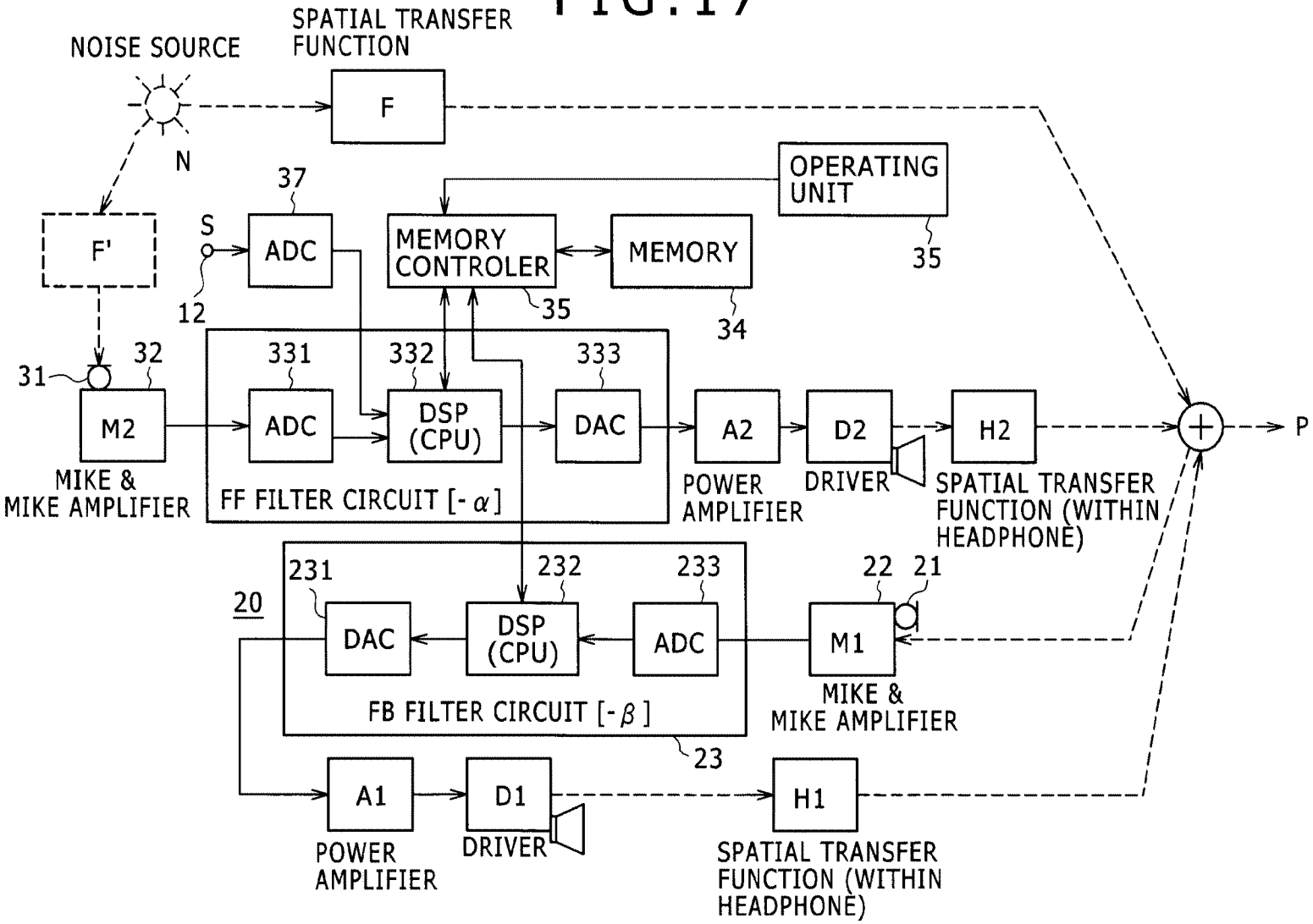
FIG. 17 is a block diagram showing an example of a headphone device to which a fifth embodiment of the noise reducing device according to the present invention is applied.

Incidentally, FIG. 17 shows a block configuration using transfer functions. In the noise reducing device section 20 of the feedback system, a transfer function corresponding to a part of a microphone 21 and a mike amplifier 22 is M1. The transfer function of a power amplifier for subjecting a noise reducing audio signal generated by an FB filter circuit 23 to output amplification is A1. The transfer function of a driver for acoustically reproducing the noise reducing audio signal is D1. A spatial transfer function from the driver to a canceling point Pc is H1.

In the noise reducing device section 30 of the feed forward system, a transfer function corresponding to a part of a microphone 31 and a mike amplifier 32 is M2. The transfer function of a power amplifier for subjecting a noise reducing audio signal generated by an FF filter circuit 33 to output amplification is A2. The transfer function of a driver for acoustically reproducing the noise reducing audio signal is D2. A spatial transfer function from the driver to the canceling point Pc is H2.

In the embodiment of FIG. 17, a memory 34 stores a plurality of sets of filter coefficients to be supplied to each of the FB filter circuit 23 and the FF filter circuit 33. Memory controllers 25 and 35 each select an appropriate filter coefficient from the plurality of sets of filter coefficients for each of the memory controllers 25 and 35 according to a button operation by a user via an operating unit 36 as described above. The memory controllers 25 and 35 then set the filter coefficients in the filter circuits 23 and 33, respectively.

In the example of FIG. 17, a system for acoustically reproducing the noise reducing audio signal generated in the noise reducing device section of the feedback system and a system for acoustically reproducing the noise reducing audio signal generated in the noise reducing device section of the feed forward system are provided separately from each other. In the example of FIG. 17, the power amplifier and the driver of the system for acoustically reproducing the noise reducing audio signal generated in the noise reducing device section of the feedback system are used only for noise reduction, while the power amplifier and the driver of the system for acoustically reproducing the noise reducing audio signal generated in the noise reducing device section of the feed forward system are used not only for noise reduction but also for acoustically reproducing an audio signal S to be listened to.

The audio signal S to be listened to in the example of FIG. 17 is converted into a digital audio signal by an A/D converter circuit 37, and then supplied to a DSP 332 in the FF filter circuit 33. Though not shown in the figure, the DSP 332 in this example includes not only a digital filter for generating the noise reducing audio signal of the feed forward system but also an equalizer circuit for adjusting the audio characteristic of the audio signal S to be listened to and an adding circuit. An output audio signal of the equalizer circuit and the noise reducing audio signal generated in the digital filter are added together in the adding circuit, and then output from the DSP 332.

The noise reducing device section 20 of the feedback system and the noise reducing device section 30 of the feed forward system in the fifth embodiment perform noise reducing process operation as described above independently of each other. However, the noise canceling point Pc is the same position in both systems.

Thus, according to the fifth embodiment, the noise reducing processes of the feedback system and the feed forward system operate complementarily, and thus a noise reducing system providing advantages of both systems can be realized.

Incidentally, in FIG. 17, the filter coefficients of the digital filters in both of the feedback system and the feed forward system are changed. However, the filter coefficient of only the digital filter of one system, for example only the digital filter of the feed forward system may be selected and changed.

In addition, in the example of FIG. 17, the FB filter circuit 23 and the FF filter circuit 33 are formed by respective separate DSPs. However, the FB filter circuit 23 and the FF filter circuit 33 can be formed by one DSP to simplify the entire circuit configuration. In addition, in the example of FIG. 17, the power amplifier and the driver in the noise reducing device section 20 of the feedback system are provided separately from the power amplifier and the driver in the noise reducing device section 30 of the feed forward system. However, the power amplifiers and the drivers can be formed by one power amplifier 15 and one driver 11 as in the foregoing embodiments. An example of such formations is shown in FIG. 18.

Figure 18:
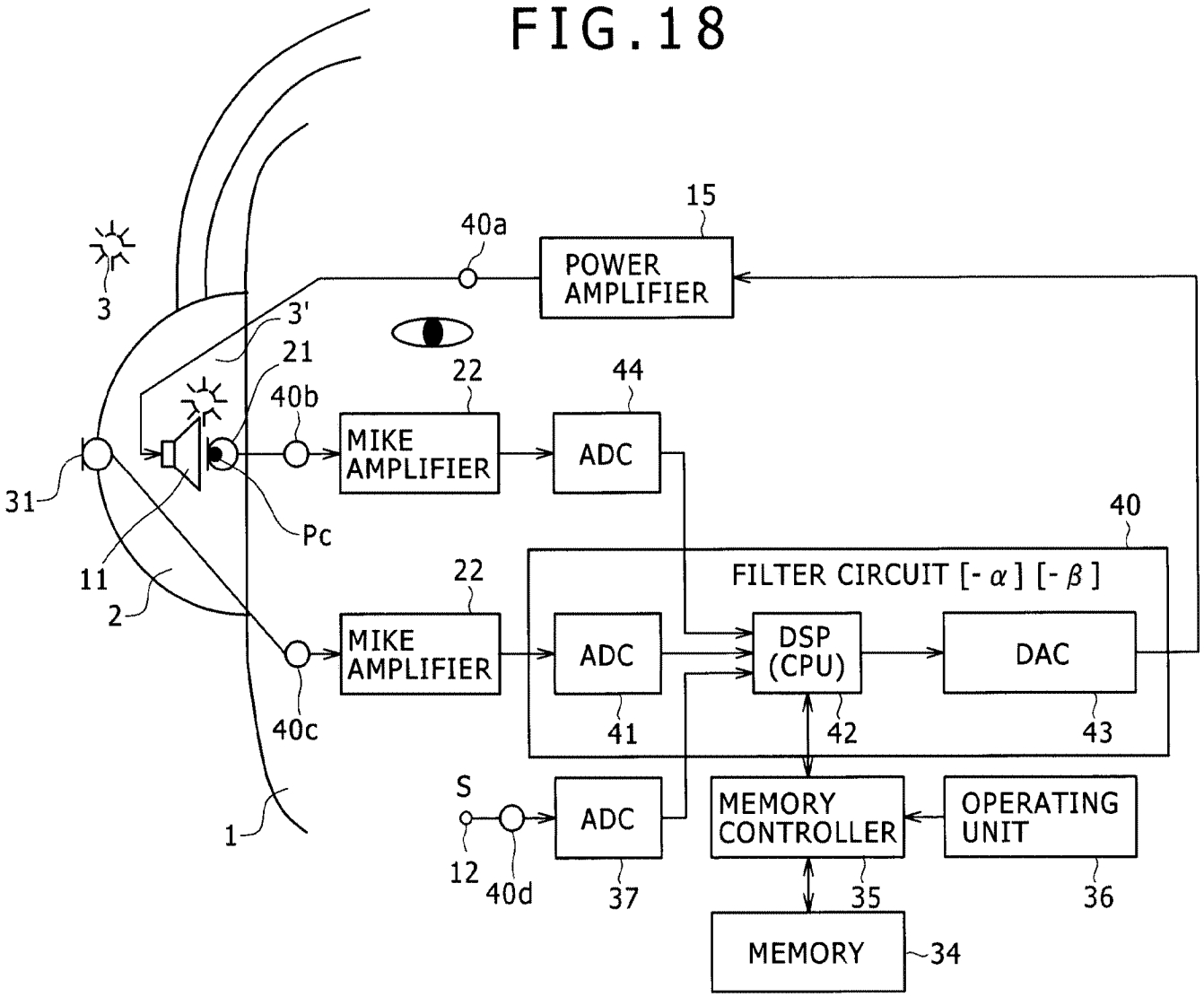
FIG. 18 is a block diagram showing another example of the headphone device to which the fifth embodiment of the noise reducing device according to the present invention is applied.

Specifically, the example of FIG. 18 has a filter circuit 40 including an A/D converter circuit 41, a DSP 42, and a D/A converter circuit 43. An analog audio signal from a mike amplifier 22 is converted into a digital audio signal by an A/D converter circuit 44. The digital audio signal is then supplied to the DSP 42. An audio signal S to be listened to which signal is input via an input terminal 12 is converted into a digital audio signal by an A/D converter circuit 37. The digital audio signal is then supplied to the DSP 42.

Figure 19:
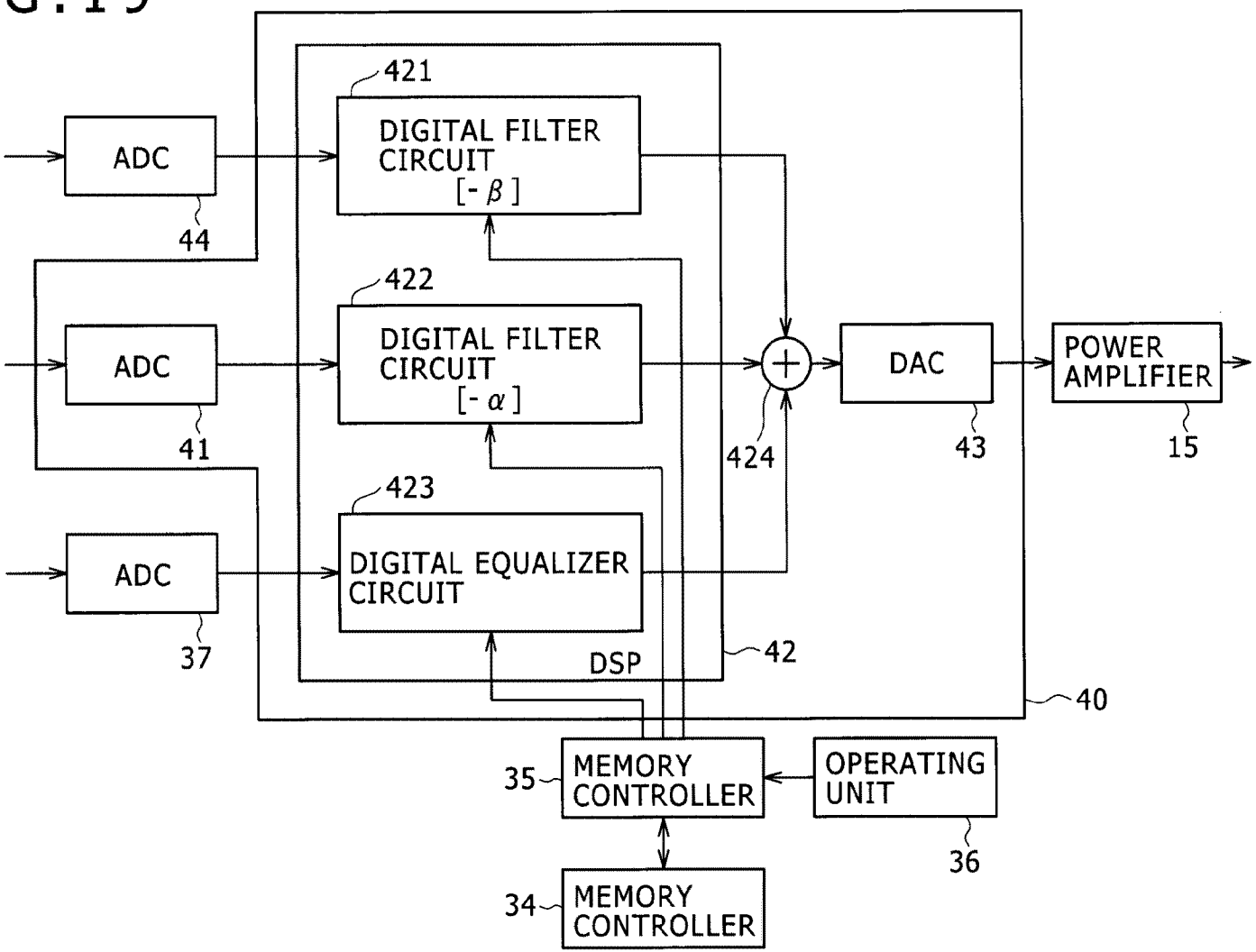
FIG. 19 is a diagram showing an example of detailed configuration of a part of the blocks in FIG. 18.

In this example, as shown in FIG. 19, the DSP 42 includes: a digital filter circuit 421 for obtaining a noise reducing audio signal of the feedback system; a digital filter circuit 422 for obtaining a noise reducing audio signal of the feed forward system; a digital equalizer circuit 423; and an adding circuit 424.

The digital audio signal (digital signal of sound collected by a microphone 21) from the A/D converter circuit 44 is supplied to the digital filter circuit 421. A digital audio signal (digital signal of sound collected by a microphone 31) from the A/D converter circuit 41 is supplied to the digital filter circuit 422. The digital audio signal (digital signal of sound to be listened to) from the A/D converter circuit 37 is supplied to the equalizer circuit 423.

As described above, in the present example, a memory 34 stores a plurality of (plurality of sets of) filter coefficients for the digital filter circuit 421 and a plurality of (plurality of sets of) filter coefficients for the digital filter circuit 422. According to a user operation via an operating unit 36, a memory controller 35 selects a filter coefficient for the digital filter circuit 421 and the digital filter circuit 422 from the memory 34. The memory controller 35 supplies the filter coefficients to the digital filter circuit 421 and the digital filter circuit 422.

The memory 34 also stores parameters for making the equalizer characteristic of the digital equalizer circuit 423 correspond to the plurality of (plurality of sets of) filter coefficients for the digital filter circuit 422. According to a user operation via the operating unit 36, the memory controller 35 selectively reads a parameter for the equalizer characteristic from the memory 34 in such a manner as to correspond to the selection of the filter coefficient for the digital filter circuit 422. The memory controller 35 then supplies the parameter to the digital equalizer circuit 423.

Noise reducing audio signals generated in the digital filter circuit 421 and the digital filter circuit 422 and a digital audio signal from the equalizer circuit 423 are supplied to the adding circuit 424 to be added together. A result of the addition is supplied to the D/A converter circuit 43 to be converted into an analog audio signal. The analog audio signal from the D/A converter circuit 43 is supplied to a driver 11 via a power amplifier 15. Thereby, noise 3' is reduced (cancelled) at a noise canceling point Pc.

References 40*a*, 40*b*, 40*c*, and 40*d* in FIG. 18 denote a connecting terminal part for connecting cables between the noise reducing device section and the driver 11, the microphone 21, the microphone 31, and the input terminal 12 (headphone plug).

Sixth Embodiment

In view of the problem of the delays in the A/D converter circuit and the D/A converter circuit in the fifth embodiment, which performs only digital processing, the sixth embodiment remedies the problem in question, as in the third and fourth embodiments described above.

Figure 20:
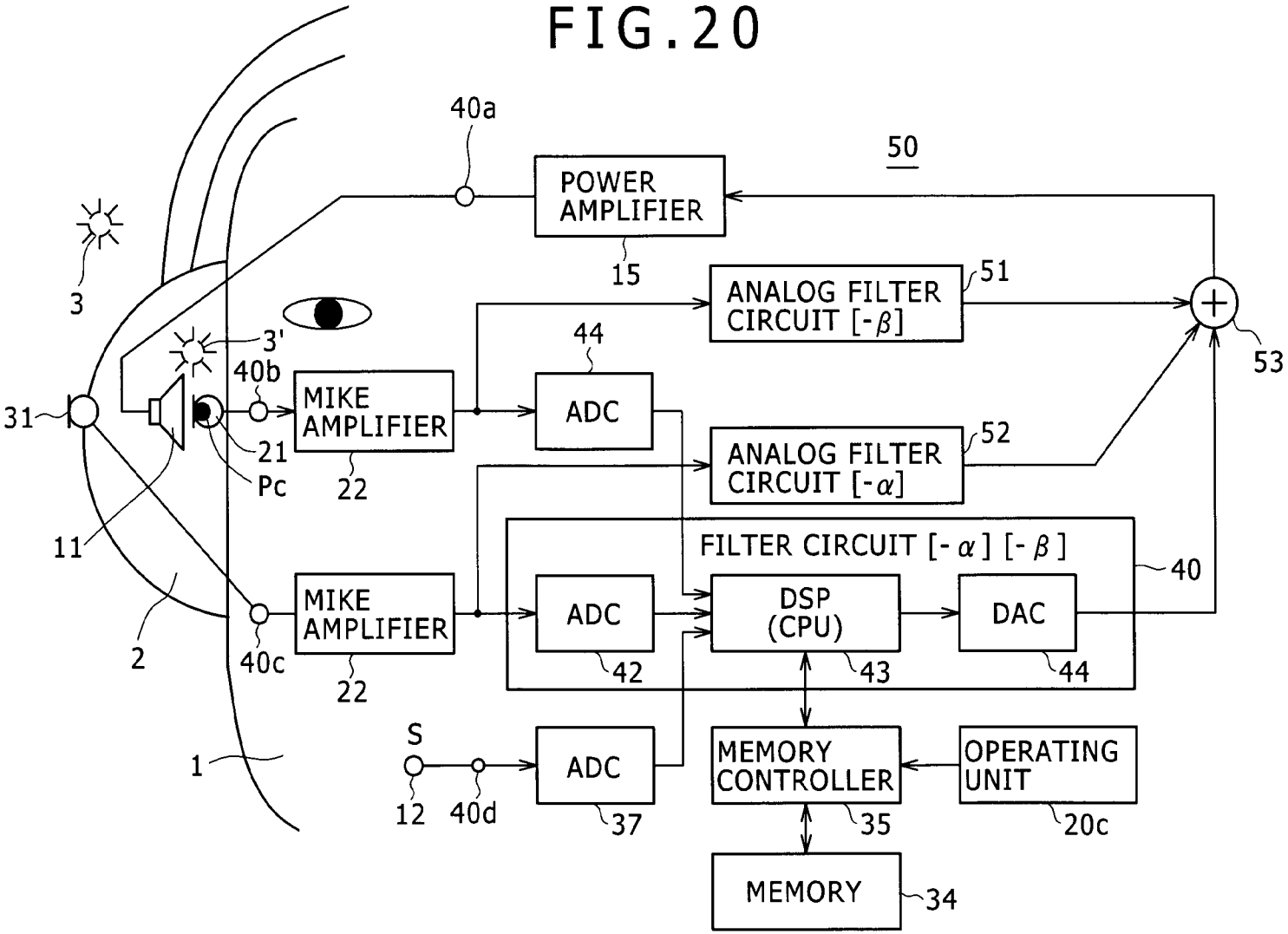
FIG. 20 is a block diagram showing an example of a headphone device to which a sixth embodiment of the noise reducing device according to the present invention is applied.

Specifically, as with the third embodiment and the fourth embodiment shown in FIG. 14 and FIG. 16, the sixth embodiment has an analog filter system in parallel with a digital filter system. FIG. 20 is a block diagram of an example of a noise reducing device section 50 according to the sixth embodiment.

In the noise reducing device section 50 according to the sixth embodiment, as shown in FIG. 20, an analog filter circuit 51 for generating an analog noise reducing audio signal of the feedback system, an analog filter circuit 52 for generating an analog noise reducing audio signal of the feed forward system, and an adding circuit 53 are added to the configuration of FIG. 19.

An analog audio signal from a mike amplifier 22 is supplied to an A/D converter circuit 44, and also supplied to the analog filter circuit 51 for generating an analog noise reducing audio signal of the feedback system. The analog noise reducing audio signal from the analog filter circuit 51 is supplied to the adding circuit 53.

An analog audio signal from a mike amplifier 32 is supplied to an A/D converter circuit 41, and also supplied to the analog filter circuit 52 for generating an analog noise reducing audio signal of the feed forward system. The analog noise reducing audio signal from the analog filter circuit 52 is supplied to the adding circuit 53.

The adding circuit 53 is further supplied with an addition signal obtained by adding together a noise reducing audio signal and an audio signal to be listened to from a filter circuit 40. Then, an audio signal from the adding circuit 53 is supplied to a driver 11 via a power amplifier 15. The present embodiment thereby uses both of the noise reducing process of the feedback system and the noise reducing process of the feed forward system, and solves the problem in generating a noise reducing audio signal by only a digital filter. It is thus possible to provide a noise reducing device and a headphone device that can be realized for the general consumer.

Examples of Modification of Manual Selection System (First to Sixth Embodiments In the first to sixth embodiments, each time the push switch of the operating unit 26 is pressed, a filter coefficient corresponding to a different noise environment is read from the memory 24 in order and cyclically, and then supplied to the FB filter circuit 23. However, each time the listener presses the push switch, the name of a different noise environment (such as "a platform in a railway station", "an airport", "the inside of a train", or the like) may be displayed on a display unit, or the adding circuit 14 may add an audio signal of the name of the noise environment to the audio signal to be acoustically reproduced by the driver 11, so that the user is informed of the noise environment for which the filter coefficient is changed.

When the noise reducing device section has a display screen, a list of the names of noise environments corresponding respectively to a plurality of kinds of selectable filter coefficients can be displayed on the display screen so that the user selects and specifies a filter coefficient for a noise environment considered to be appropriate from the list screen.

In addition, the operating units 26 and 36 are not limited to the push switch, and operating devices of various configurations can be used. For example, light hitting (tapping) of the headphone casing 2 by the listener 1 may be detected by using a vibration sensor or the like, and as with the pressing of the push switch, detection output of the vibration sensor or the like may be set as timing of changing to a next filter coefficient.

In addition, the above-described embodiments change the filter coefficient each time a user operation is performed. However, when a user operation is performed, the memory controller 25 or 35 may sequentially set each of a plurality of filter coefficients from the memory 24 or 34 in the digital filter for a predetermined fixed period to allow the listener to listen for the fixed period.

In this case, an input indicating what number filter coefficient is most suitable is received from the listener after the listener finishes listening for all the filter coefficients. Alternatively, while a filter coefficient judged to be an optimum filter coefficient by the user is selected, the user performs a predetermined user operation. The user thereby determines the optimum filter coefficient. In the latter case, it is desirable that the operation of sequentially selecting the plurality of filter coefficients to allow the listener to listen for the fixed period be repeated a number of times for the plurality of filter coefficients.

Incidentally, in a case where the audio signal S to be listened to is being reproduced when the user is to determine an optimum filter coefficient, and thus it is difficult for the user to make the determination, it is desirable to mute the audio signal S forcefully for such a predetermined time as allows the user to determine noise reduction effect, when a user operation for changing the filter coefficient is performed.

[Automatic Changing System]

All of the above first to sixth embodiments select a filter coefficient to be set in the digital filter according to a user operation, and then sets the filter coefficient. Embodiments to be described below automatically set a filter coefficient corresponding to a noise environment in a place where the headphone device is used.

As will be described below, there are a few examples of a configuration for thus automatically setting a filter coefficient corresponding to a noise environment in a place where the headphone device is used. These examples are applied in place of the manual selection based on the operation of the operating unit 26 or 36 in the first to sixth embodiments described above, and are thereby applicable to the noise reducing devices of the configurations of the first to sixth embodiments. A few embodiments of the examples will be described in the following.

Seventh Embodiment

Figure 21:
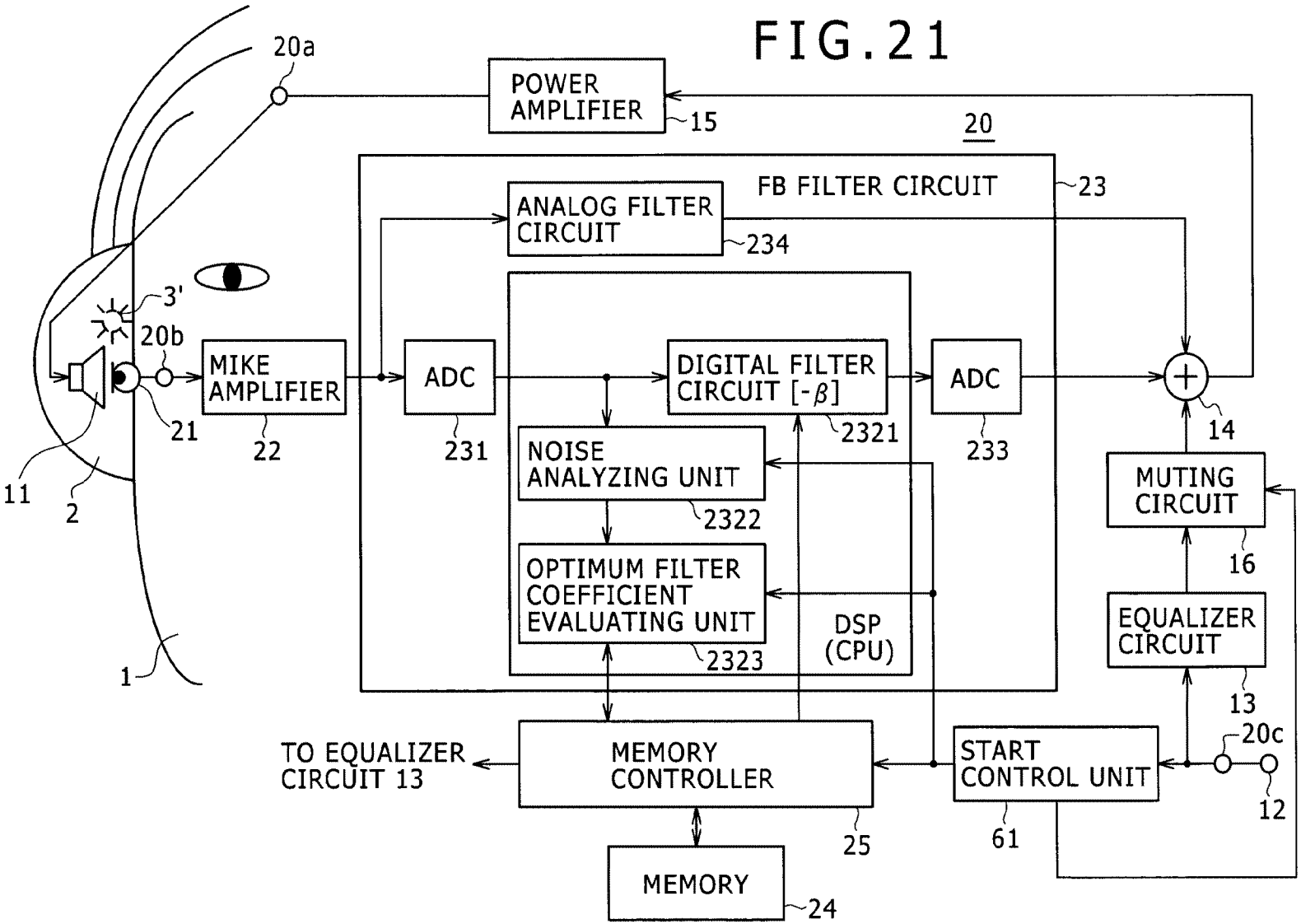
FIG. 21 is a block diagram showing an example of a headphone device to which a seventh embodiment of the noise reducing device according to the present invention is applied.

A seventh embodiment adopts an automatic selection method as described below in place of the operating unit 26 in the configuration of the third embodiment having the above-described feedback system and the analog filter system in parallel. FIG. 21 is a block diagram showing an example of configuration of a headphone device according to the seventh embodiment.

A DSP 232 of an FB filter circuit 23 in the seventh embodiment includes not only a digital filter circuit 2321 ready for the feedback system but also a noise analyzing unit 2322 and an optimum characteristic evaluating unit 2323.

The noise analyzing unit 2322 analyzes the characteristic of noise collected by a microphone 21, and then supplies a result of the analysis to the optimum filter coefficient evaluating unit 2323. The optimum filter coefficient evaluating unit 2323 in the present embodiment selects a filter coefficient providing a noise reducing curve characteristic closest to an inverse characteristic curve to a noise waveform curve based on the result of the analysis from the noise analyzing unit 2322 from a plurality of filter coefficients stored in a memory 24. The optimum filter coefficient evaluating unit 2323 thereby determines one optimum filter coefficient (one optimum set of filter coefficients). The optimum filter coefficient evaluating unit 2323 then supplies the determination result to a memory controller 25.

In response to the result of the determination of the optimum filter coefficient from the optimum filter coefficient evaluating unit 2323, the memory controller 25 reads a filter coefficient corresponding to the result of the determination of the optimum filter coefficient from the memory 24. The memory controller 25 then supplies the filter coefficient to the digital filter circuit 2321 to set the filter coefficient in the digital filter circuit 2321.

The seventh embodiment controls starting of the process operation of automatically selecting the above-described optimum filter coefficient by a start control signal from a start control unit 61. Specifically, the start control signal from the start control unit 61 is supplied to the memory controller 25, and is also supplied to the noise analyzing unit 2322 and the optimum filter coefficient evaluating unit 2323.

It is better to analyze noise in an environment free from acoustically reproduced sound based on an audio signal S to be listened to. The audio signal S input via an input terminal 12 in the seventh embodiment is supplied to an equalizer circuit 13 and is also supplied to the start control unit 61. A muting circuit 16 for muting the audio signal S is provided between the equalizer circuit 13 and an adding circuit 14.

When the process operation of automatically selecting the optimum filter coefficient is to be started, the start control unit 61 determines whether or not the audio signal S is present. When the start control unit 61 determines that the audio signal S is present, the start control unit 61 mutes the audio signal S from the equalizer circuit 13 for a predetermined time in the muting circuit 16 by a muting control signal, so that a position of sound collection by the microphone 21 is controlled to be free from the reproduced sound based on the audio signal S. The predetermined time in this case is a time necessary to be able to perform noise analysis and select an optimum filter coefficient.

The start control unit 61 in the present embodiment starts the process operation of automatically selecting an optimum filter coefficient in the following timing. The start timing is for example (1) at a time of turning on power, (2) when a listener operates an automatic selection process starting switch, (3) at fixed time intervals, (4) when a great change occurs in noise, and (5) when noise at a predetermined level or higher is detected.

When the headphone device is supplied with a power supply voltage from a reproducing device reproducing the audio signal S, whether the power is turned on in the above case of (1) can be determined by the start control unit 61 detecting whether a headphone plug forming the input terminal 12 is inserted into a headphone jack of the reproducing device and thereby the power supply voltage is supplied.

In the above case of (2), the start control unit 61 has the automatic selection process starting switch not shown in the figure. The start control unit 61 determines the start timing on the basis of whether the automatic selection process starting switch is operated.

In addition, without the automatic selection process starting switch being provided, for example, light hitting (tapping) of the headphone casing 2 by the listener 1 may be detected from a sound collection audio signal of the microphone 21 or 31, and the detection output may be set as timing of starting the process operation of automatically selecting an optimum filter coefficient.

In the above case of (3), the start control unit 61 has an interval timer not shown in the figure. Each time the start control unit 61 measures a predetermined time set in advance with the interval timer, the start control unit 61 starts the process operation of automatically selecting an optimum filter coefficient. In this case, the predetermined time measured by the interval timer can be set by the listener. When the listener is moving while listening to the audio signal S from the reproducing device through the headphone device, for example, the listener can set the predetermined time measured by the interval timer to a short time. When the listener is not moving while listening to the audio signal S from the reproducing device through the headphone device, for example, the listener can set the predetermined time measured by the interval timer to a long time.

In the above case of (4), the start control unit 61 in the present embodiment collects noise in interruption timing having a predetermined cycle when the audio signal S is not reproduced. When the audio signal S is reproduced, the start control unit 61 collects noise in a silence section of the audio signal S. Then, when the start control unit 61 determines that a different between the collected noise and noise collected in previous timing exceeds a predetermined threshold value set in advance, the start control unit 61 starts the process operation of automatically selecting an optimum filter coefficient. This is because it can be determined that the noise environment is changed when the noise changes greatly.

In the above case of (5), as in the above case of (4), the start control unit 61 collects noise in interruption timing having a predetermined cycle when the audio signal S is not reproduced. When the audio signal S is reproduced, the start control unit 61 collects noise in a silence section of the audio signal S. Then, when the start control unit 61 determines that the collected noise exceeds a predetermined threshold value set in advance, the start control unit 61 starts the process operation of automatically selecting an optimum filter coefficient. This is because it can be considered that it is better to perform noise reduction when a low-noise state changes to a high-noise state.

The above cases of (1) to (5) as described above are an example of timing of starting the process operation of automatically selecting an optimum filter coefficient, and it is needless to say that the start timing may be other timing. In addition, it is not necessary to use all the start timings of the above cases of (1) to (5), and it suffices to use one or more of the start timings.

Figure 22:
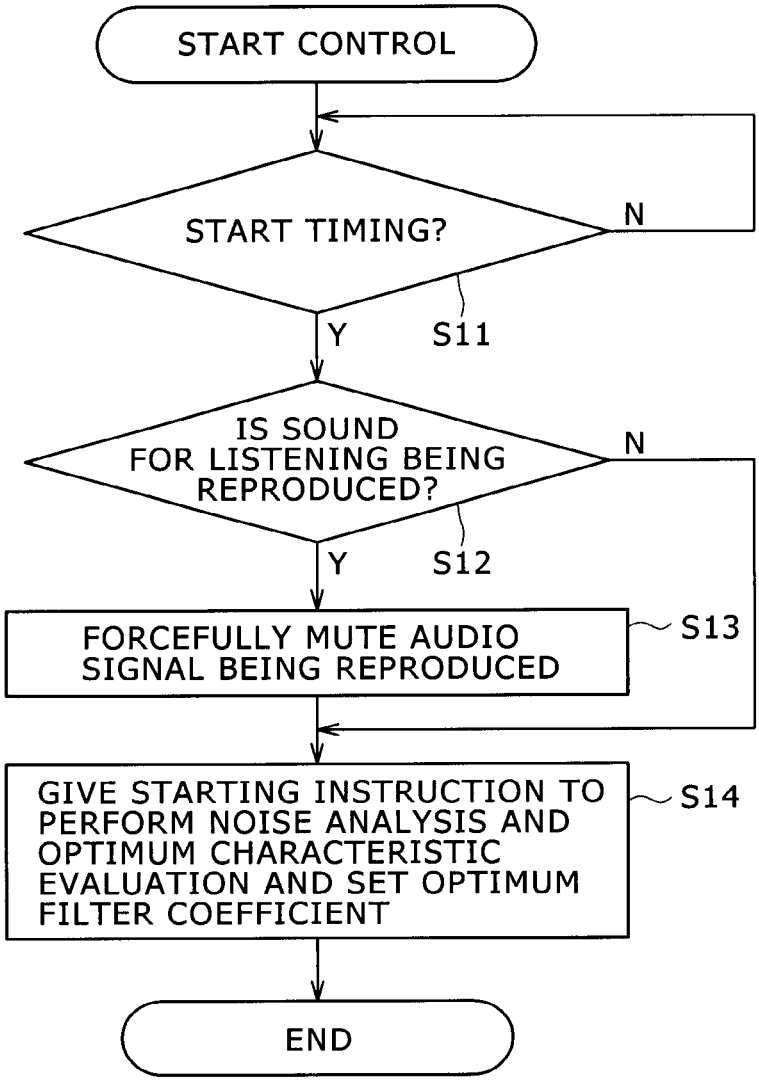
FIG. 22 is a flowchart of assistance in explaining operation of principal parts in the seventh embodiment of the noise reducing device according to the present invention.

FIG. 22 is a flowchart showing an example of a flow of the process operation in the start control unit 61. The start control unit 61 monitors to determine whether or not timing of starting the process operation of automatically selecting an optimum filter coefficient has arrived (step S11).

When determining that the start timing has arrived in step S11, the start control unit 61 determines whether the audio signal S to be listened to is being reproduced on the basis of presence or absence of the audio signal S (step S12).

When determining that the audio signal S is not being reproduced in step S12, the start control unit 61 sends a start control signal to the noise analyzing unit 2322, the optimum filter coefficient evaluating unit 2323, and the memory controller 25 to start the process operation of automatically selecting an optimum filter coefficient (step S14).

When determining that the audio signal S is being reproduced in step S12, the start control unit 61 supplies a muting control signal to the muting circuit 16 to perform muting control forcefully on the audio signal S being reproduced for a predetermined time (step S13).

Proceeding to step S14 following step S13, the start control unit 61 sends a start control signal to the noise analyzing unit 2322, the optimum filter coefficient evaluating unit 2323, and the memory controller 25 to start the process operation of automatically selecting an optimum filter coefficient.

Figure 23:
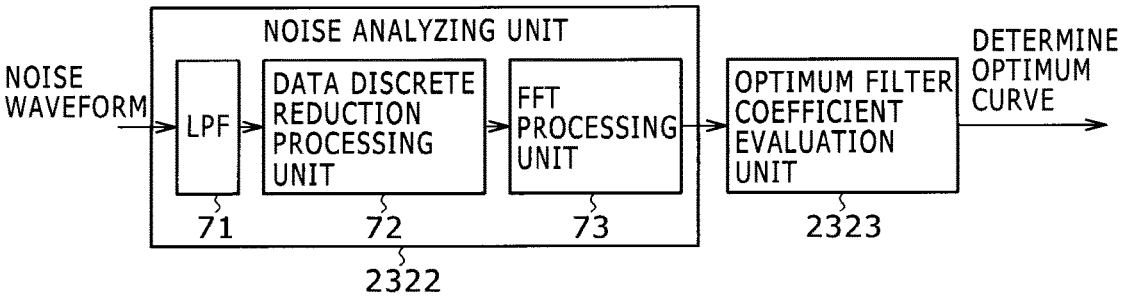
FIG. 23 is a diagram showing a concrete example of configuration of a part of the blocks in the example of configuration of the seventh embodiment in FIG. 21.

A concrete example of the noise analyzing unit 2322 and the optimum filter coefficient evaluating unit 2323 will next be described. FIG. 23 shows a first concrete example of a configuration of the noise analyzing unit 2322 and the optimum filter coefficient evaluating unit 2323. This example represents a method of performing noise analysis and detection using FFT (Fast Fourier Transform) processing on noise waveform.

As shown in FIG. 23, a signal from an A/D converter circuit 231 (which signal is composed of noise because the audio signal S is not present when the process operation of automatically selecting an optimum filter coefficient has been started, as described above) is supplied to a low-pass filter 71 in the noise analyzing unit 2322 so that a high-frequency component of the signal is removed. The signal is thereafter supplied to a data discrete reduction processing unit 72 so that data of the signal is discretely reduced appropriately. Then, data for a predetermined period from the data discrete reduction processing unit 72 is supplied to an FFT processing unit 73 to be subjected to an FFT operation. A result of the FFT operation is supplied to the optimum filter coefficient evaluating unit 2323.

The optimum filter coefficient evaluating unit 2323 recognizes a noise waveform curve from the result of the FFT operation. The optimum filter coefficient evaluating unit 2323 then selects a filter coefficient providing an attenuating curve characteristic close to an inverse curve characteristic to the noise waveform curve from a plurality of filter coefficients in the memory 24.

For example, when noise reducing characteristics based on the plurality of filter coefficients stored in the memory 24 are as shown in FIG. 6 described earlier, and the noise waveform curve of the result of the FFT operation has energy mainly in a low-frequency band, the filter coefficient providing the noise reducing characteristic of the (1) low frequency band oriented curve is selected as optimum filter coefficient.

The low-pass filter 71 and the data discrete reduction processing unit 72 are used in FIG. 23 because noise characteristics include a large amount of low-frequency components in the first place, and because generally it is difficult to control a high-frequency band accurately and it is difficult to apply noise cancellation to a high-frequency band in the first place, so that down sampling can be performed to reduce an amount of calculation.

Incidentally, in this example, the memory 24 may store FFT results for inverse characteristic curves to attenuating curves at times of respective filter coefficients so that a comparison between an FFT result from the FFT processing unit 73 and the stored FFT results for the inverse characteristic curves to the attenuating curves at the times of the respective filter coefficients is made to set a filter coefficient corresponding to an inverse characteristic curve having a small error as optimum filter coefficient.

Figure 24:
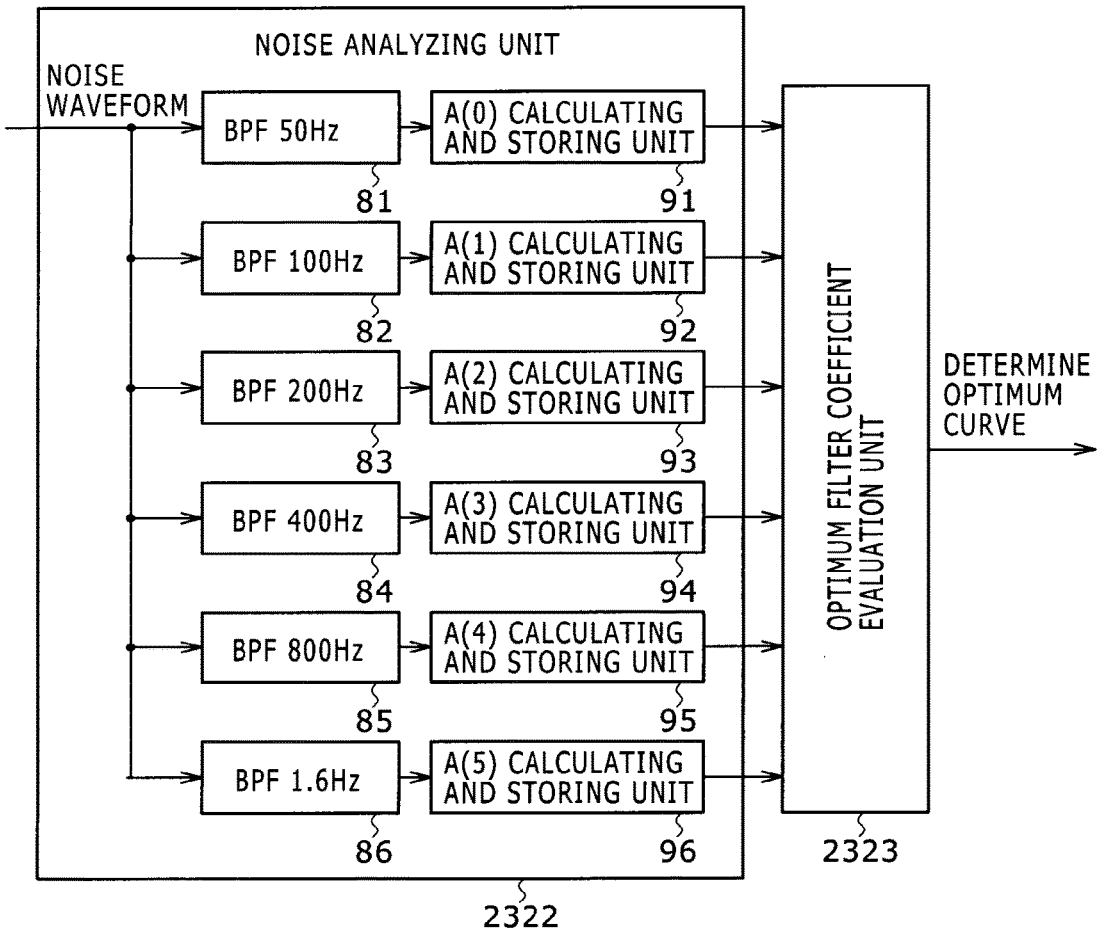
FIG. 24 is a diagram showing a concrete example of configuration of a part of the blocks in the example of configuration of the seventh embodiment in FIG. 21.

Description will next be made of a second concrete example of the noise analyzing unit 2322 and the optimum filter coefficient evaluating unit 2323. FIG. 24 shows the second concrete example of the noise analyzing unit 2322 and the optimum filter coefficient evaluating unit 2323.

As shown in FIG. 24, the noise analyzing unit 2322 in the second example includes a plurality of band-pass filters, or six band-pass filters 81, 82, 83, 84, 85, and 86 in this example, and six energy value calculating and storing units 91, 92, 93, 94, 95, and 96 for calculating the energy values of respective outputs of the six band-pass filters 81, 82, 83, 84, 85, and 86 as dB values, and storing the energy values in a built-in register.

In this example, the pass center frequencies of the six band-pass filters 81, 82, 83, 84, 85, and 86 are 50 Hz, 100 Hz, 200 Hz, 400 Hz, 800 Hz, and 1.6 kHz.

A signal from the A/D converter circuit 231 (which signal is composed of noise because the audio signal S is not present when the process operation of automatically selecting an optimum filter coefficient has been started, as described above) is supplied to each of the six band-pass filters 81, 82, 83, 84, 85, and 86. Then, the respective outputs of the six band-pass filters 81, 82, 83, 84, 85, and 86 are supplied to the six energy value calculating and storing units 91, 92, 93, 94, 95, and 96, so that energy values A(0), A(1), A(2), A(3), A(4), and A(5) are calculated and stored in the built-in registers, respectively.

Figure 25:
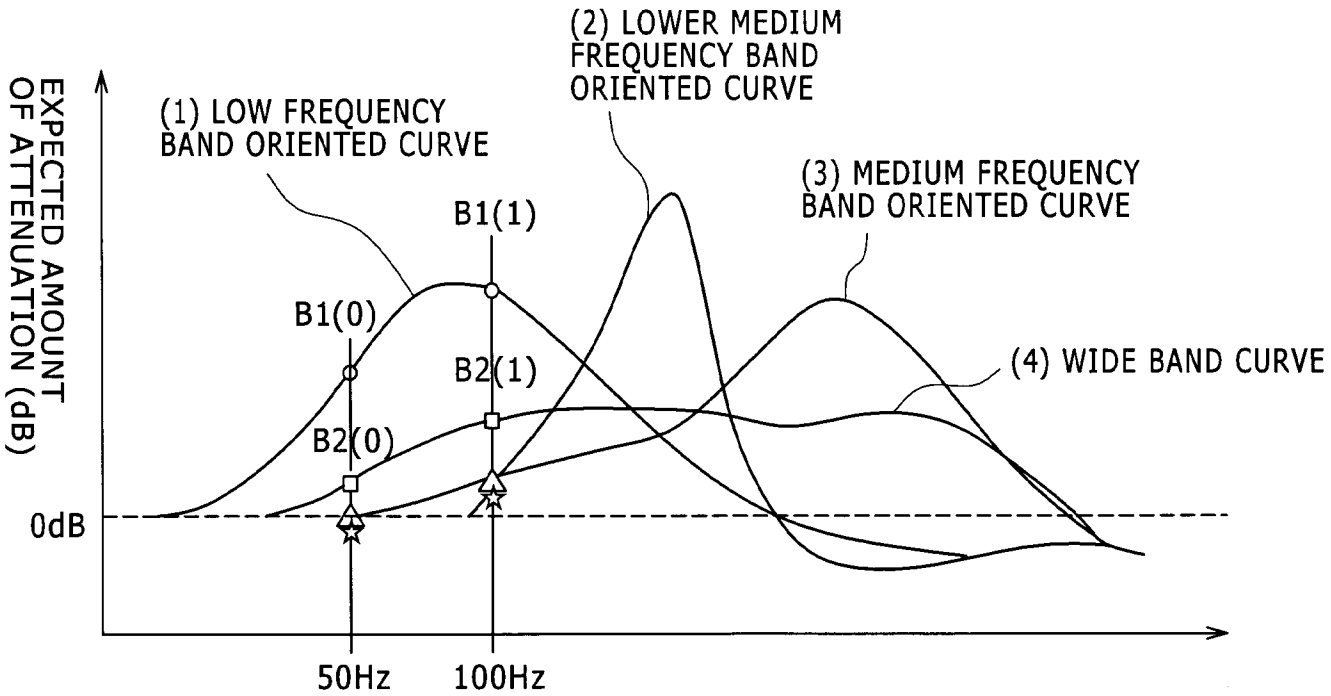
FIG. 25 is a diagram of assistance in explaining operation of principal parts in the seventh embodiment of the noise reducing device according to the present invention.

As shown in FIG. 25, for example, the memory 24 in the second example stores four sets of filter coefficients corresponding to the four kinds of noise reducing curves (1), (2), (3), and (4) described above, and stores attenuation amount representative values (dB values) at 50 Hz, 100 Hz, 200 Hz, 400 Hz, 800 Hz, and 1.6 kHz in the noise reducing curves (1), (2), (3), and (4) in correspondence with the respective filter coefficients.

For example, the attenuation amount representative values (dB values) at 50 Hz, 100 Hz, 200 Hz, 400 Hz, 800 Hz, and 1.6 kHz in the low frequency band oriented curve (1) are stored as B1(0), B1(1), B1(2), . . . , and B1(5) in correspondence with the corresponding filter coefficients. The attenuation amount representative values (dB values) at 50 Hz, 100 Hz, 200 Hz, 400 Hz, 800 Hz, and 1.6 kHz in the lower medium frequency band oriented curve (2) are stored as B2(0), B2(1), B2(2), . . . , and B2(5) in correspondence with the corresponding filter coefficients.

The optimum filter coefficient evaluating unit 2323 in the second example detects differences between the energy values A(0), A(1), A(2), A(3), A(4), and A(5) stored in the respective energy value calculating and storing units 91 to 96 and the attenuation amount representative values of the noise reducing curves based on the filter coefficients stored in the memory 24. The optimum filter coefficient evaluating unit 2323 then determines the filter coefficient corresponding to the noise reducing curve whose sum total of differences is the smallest as optimum filter coefficient.

That is, a sum total of differences between the energy values A(0), A(1), A(2), A(3), A(4), and A(5) and the attenuation amount representative values of each of the noise reducing curves based on the filter coefficients stored in the memory 24 is equal to a residual of a result of attenuation of input noise by each of the noise reducing curves. A smaller sum total indicates that the noise is reduced more.

Figure 26:
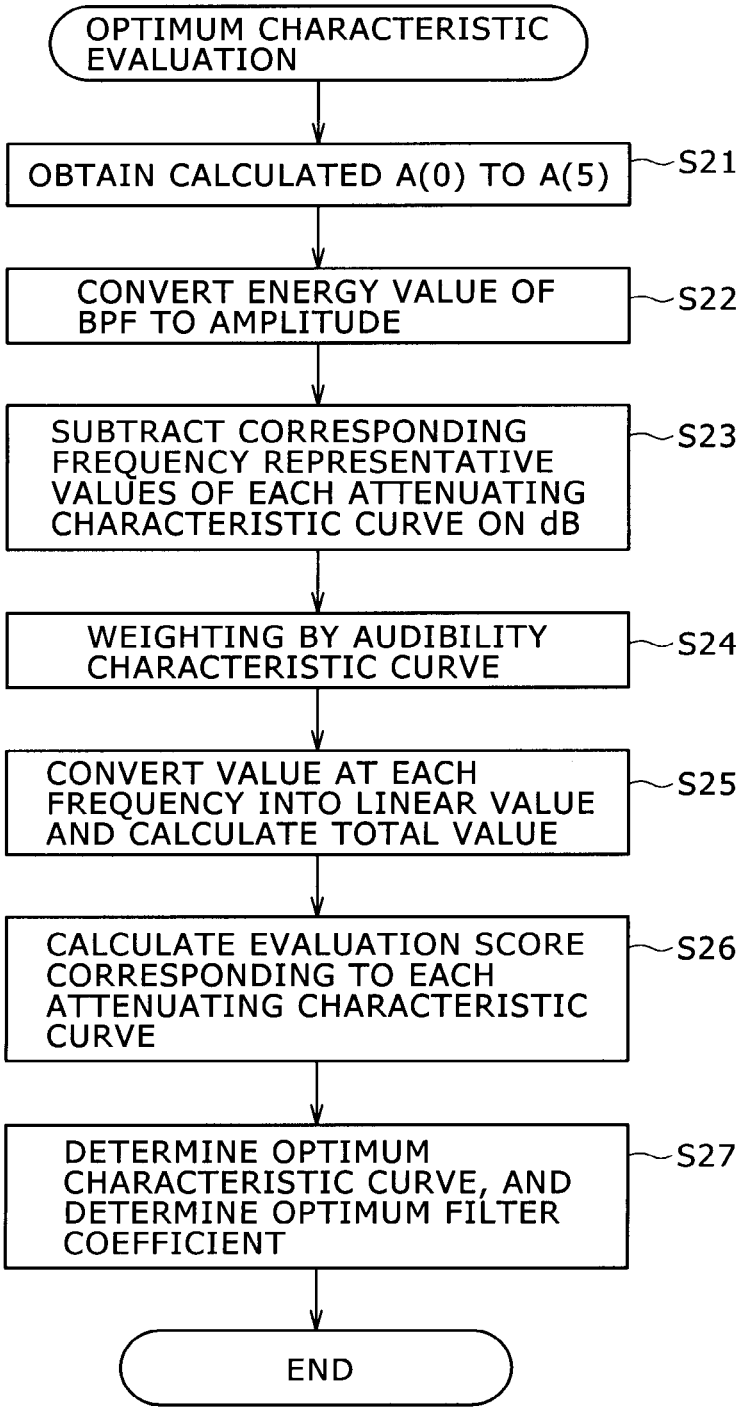
FIG. 26 is a flowchart of assistance in explaining operation of principal parts in the seventh embodiment of the noise reducing device according to the present invention.

An example of a flow of process operation in the noise analyzing unit 2322 and the optimum filter coefficient evaluating unit 2323 in the second example is represented in a flowchart of FIG. 26.

First, the energy values A(0), A(1), A(2), A(3), A(4), and A(5) of outputs of the band-pass filters 81, 82, 83, 84, 85, and 86 in the noise analyzing unit 2322 are calculated and stored in the registers (step S21).

Next, the optimum filter coefficient evaluating unit 2323 reads the stored energy values A(0) to A(5), and performs energy-to-amplitude conversion to correct the values (step S22). This correcting operation is necessary because when overall selectivity Q of each of the BPFs 81 to 86 is constant, and white noise with a constant frequency amplitude value, for example, is fed, the energy values of a passed waveform are not constant, and higher energy values are output in a low-frequency band. In addition, correction may be required depending on how the overall selectivity Q is taken. These corrections are performed in a lump.

Next, the optimum filter coefficient evaluating unit 2323 first subtracts the representative values B1(0) to B1(5) of the low frequency band oriented curve of the attenuating curve (1) from the memory 24 from the corrected values of the energy values A(0) to A(5), respectively (step S23).

Next, the optimum filter coefficient evaluating unit 2323 corrects the subtraction values by an audibility characteristic curve, and thereby obtains values C1(0) to C1(5) (step S24). The optimum filter coefficient evaluating unit 2323 next calculates a total value of linear values to which the values C1(0) to C1(5) are converted (step S25). This total value serves as an evaluation score for one attenuating curve.

The audibility characteristic curve in this case may be a so-called A-curve or a so-called C-curve, may be obtained by converting loudness with absolute sound volume taken into consideration, or may be set originally.

Then, the optimum filter coefficient evaluating unit 2323 performs the operation of steps S23 to S25 described above for all of the attenuating curves (1) to (4) to obtain an evaluation score corresponding to each of the attenuating curves (step S26).

After calculating score values corresponding to all the curves, the optimum filter coefficient evaluating unit 2323 determines that an attenuating curve corresponding to a smallest evaluation score value can be expected to have a greatest noise reduction effect, and determines a filter coefficient corresponding to the attenuating curve as optimum filter coefficient (step S27).

Incidentally, the memory controller 25 in the above-described embodiment can be formed within the DSP 232. It is also possible to form the equalizer circuit 13 within the DSP 232, convert the audio signal S into a digital signal, and supply the digital signal to the equalizer circuit within the DSP 232.

Eighth Embodiment

Figure 27:
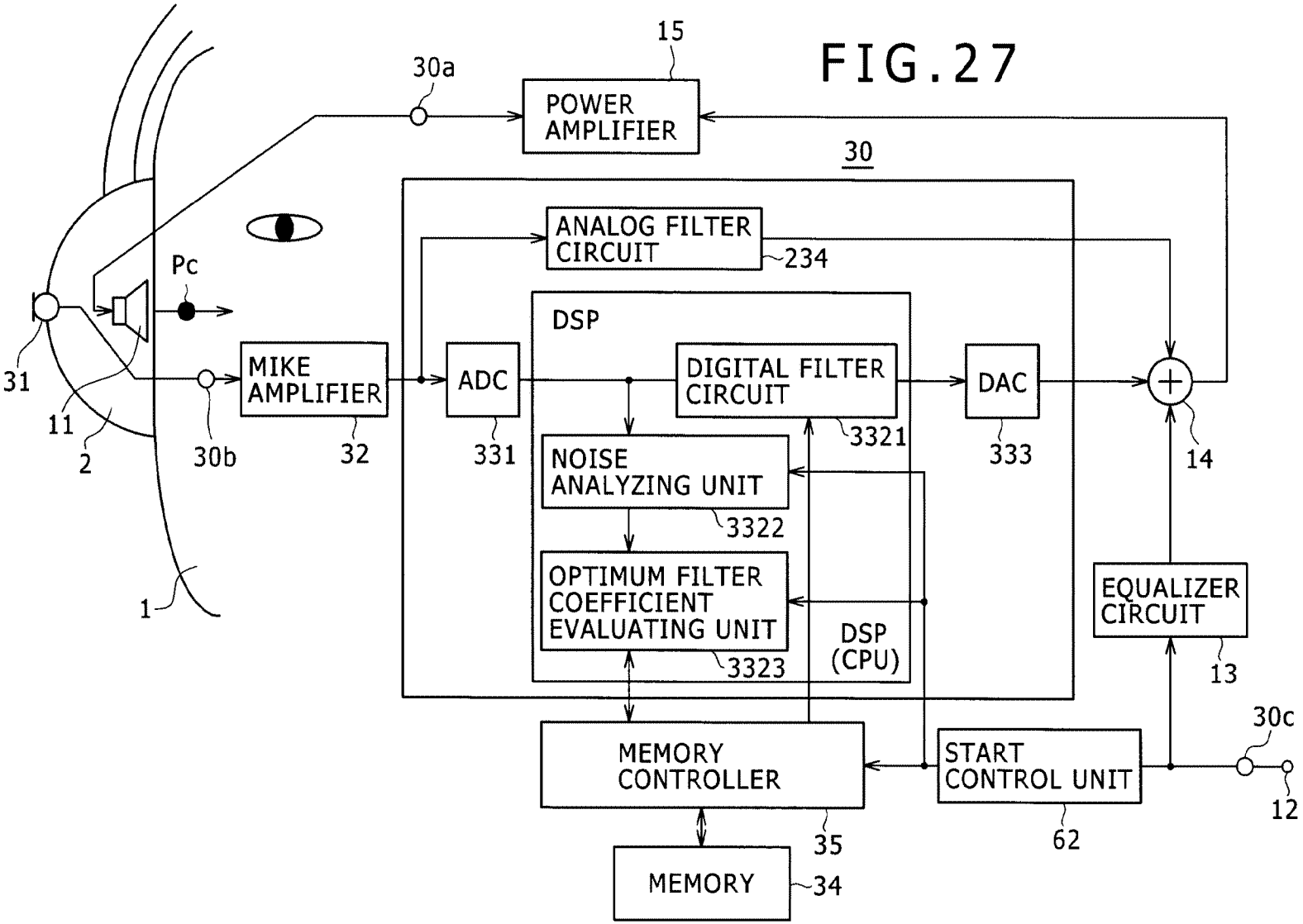
FIG. 27 is a block diagram showing an example of configuration of a headphone device according to an eighth embodiment.

An eighth embodiment adopts an automatic selection method as described below in place of the operating unit 26 in the configuration of the fourth embodiment having the above-described feed forward system and the analog filter system in parallel. FIG. 27 is a block diagram showing an example of configuration of a headphone device according to the eighth embodiment.

As in the seventh embodiment, a DSP 332 of an FF filter circuit 33 in the eighth embodiment includes not only a digital filter circuit 3321 ready for the feed forward system but also a noise analyzing unit 3322 and an optimum characteristic evaluating unit 3323.

The noise analyzing unit 3322 in the eighth embodiment analyzes the characteristic of noise collected by a microphone 31, and then supplies a result of the analysis to the optimum filter coefficient evaluating unit 3323. The configuration and process operation of the noise analyzing unit 3322 and the optimum filter coefficient evaluating unit 3323 are the same as in the seventh embodiment. However, the eighth embodiment is different from the seventh embodiment in the following respect relating to control of a start of the process operation of automatically selecting an optimum filter coefficient.

The foregoing seventh embodiment performs forceful muting when an audio signal S is reproduced, while the eighth embodiment detects a silence section of the audio signal S without performing muting, and performs the process operation of automatically selecting an optimum filter coefficient in the silence section.

That is, the eighth embodiment has a start control unit 62, but does not have a muting circuit 16 between an equalizer circuit 13 and an adding circuit 14. The start control unit 62 supplies a start control signal of the start control unit 62 to the noise analyzing unit 3322, the optimum filter coefficient evaluating unit 3323, and a memory controller 35.

A memory 34 stores a plurality of (plurality of sets of) filter coefficients corresponding to the feed forward system, as described above. As in the seventh embodiment, under start control of the start control unit 62, the memory controller 35 reads an optimum filter coefficient from the plurality of filter coefficients in the memory 34, and then sets the optimum filter coefficient in the digital filter circuit 3321. Otherwise, the eighth embodiment is formed in exactly the same manner as the seventh embodiment.

Figure 28:
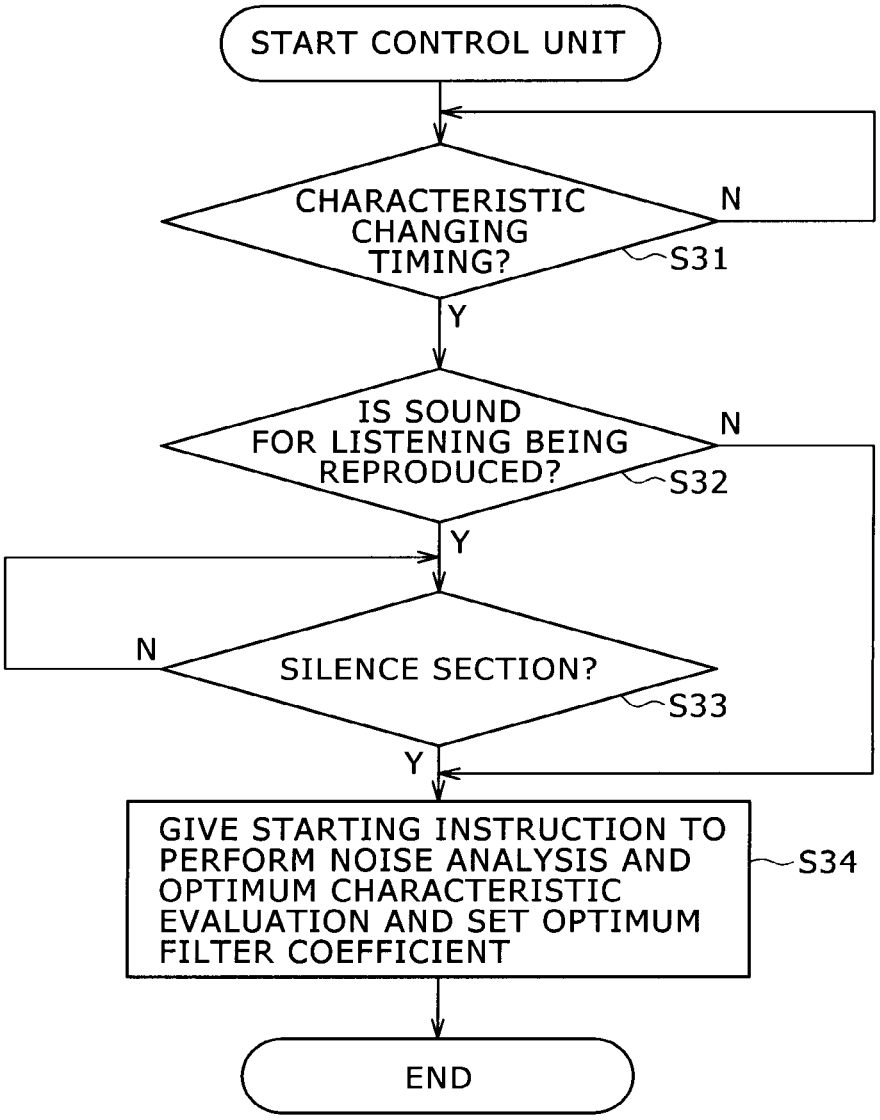
FIG. 28 is a flowchart of assistance in explaining operation of principal parts in the eighth embodiment.

An example of a flow of start control operation by the start control unit 62 of the eighth embodiment will be described with reference to a flowchart of FIG. 28.

The start control unit 62 monitors to determine whether or not timing of starting the process operation of automatically selecting an optimum filter coefficient has arrived (step S31) As with the seventh embodiment, the eighth embodiment can use the above-described start timings (1) to (5).

When the start control unit 62 determines that the start timing has arrived in step S31, the start control unit 62 determines whether the audio signal S to be listened to is being reproduced on the basis of presence or absence of the audio signal S (step S32).

When the start control unit 62 determines that the audio signal S is not being reproduced in step S32, the start control unit 62 sends a start control signal to the noise analyzing unit 3322, the optimum filter coefficient evaluating unit 3323, and the memory controller 35 to start the process operation of automatically selecting an optimum filter coefficient (step S34).

When the start control unit 62 determines that the audio signal S is being reproduced in step S32, the start control unit 62 monitors for a silence section of the audio signal S to detect the silence section (step S33). When the start control unit 62 has detected the silence section, the process proceeds to step S34, where the start control unit 62 sends a start control signal to the noise analyzing unit 2322, the optimum filter coefficient evaluating unit 2323, and the memory controller 35 to start the process operation of automatically selecting an optimum filter coefficient.

The process operation of automatically selecting an optimum filter coefficient in the eighth embodiment is the same as in the seventh embodiment, and therefore description thereof will be omitted.

Incidentally, the memory controller 35 in the above-described embodiment can be formed within the DSP 332. It is also possible to form the equalizer circuit 13 within the DSP 332, convert the audio signal S into a digital signal, and supply the digital signal to the equalizer circuit within the DSP 332.

Ninth Embodiment

In the seventh embodiment or the eighth embodiment described above, the process operation of automatically selecting an optimum filter coefficient is performed in start timing and when a silence section is created by forcefully interrupting a reproduced audio signal or when the reproduced audio signal S itself has a silence section. The ninth embodiment extracts only noise by removing the component of the reproduced audio signal S from an audio signal obtained by collecting sound from a microphone 31, and analyzes the extracted noise. Thereby, noise measurement can be made with good accuracy while reproduced sound is allowed to flow.

Figure 29:
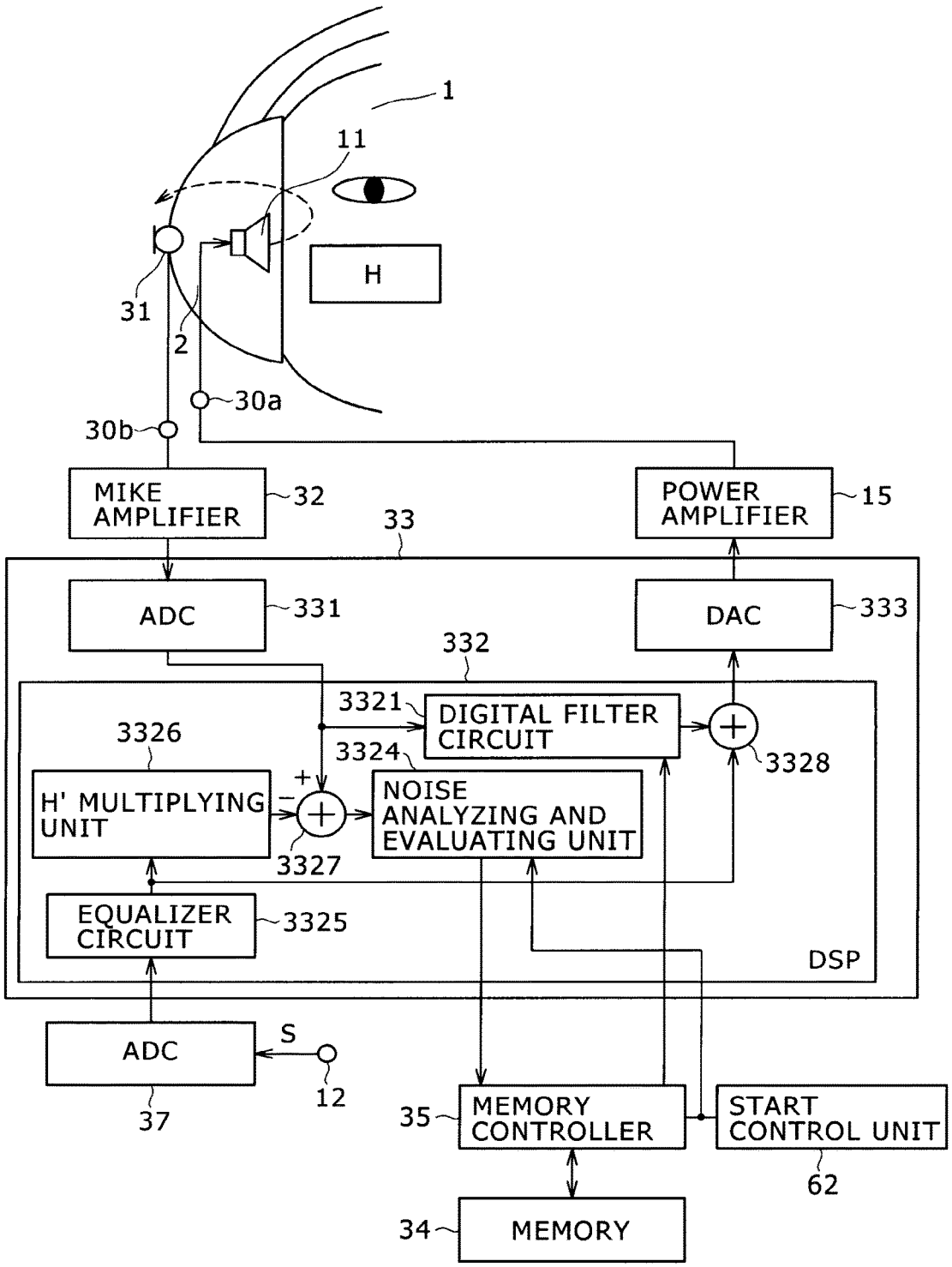
FIG. 29 is a block diagram showing an example of configuration of a headphone device according to a ninth embodiment.

Description will be made of a case where an example of configuration of a headphone device according to the ninth embodiment is applied to a noise reducing device of the feed forward system. FIG. 29 is a block diagram showing the example of configuration of the headphone device in this case.

As shown in FIG. 29, let H be a transfer function from a driver 11 within a headphone casing 2 to the microphone 31 on the outside of the headphone casing 2. The transfer function H can be made to be a known transfer function by making measurement in advance.

The transfer function H itself is often complex, including much resonance and much reflection within the headphone casing 2. In practice, because of a problem of an amount of calculation, a transfer function H' approximate to the characteristics of the transfer function H is used. In many cases, when an operation is performed using the transfer function H, the impulse response h of the transfer function H is subjected to an FIR (Finite Impulse Response) operation. However, the FIR operation by a DSP consumes a large amount of computer resources. Therefore, the characteristics of the transfer function H are approximated as the transfer function H', and this transfer function is implemented as an IIR (Infinite Impulse Response) filter.

As shown in FIG. 29, a DSP 332 in the ninth embodiment includes: a digital filter circuit 3321; a noise analyzing and evaluating unit 3324 including a noise analyzing unit 3322 and an optimum filter coefficient evaluating unit 3323 as described above; a digital equalizer circuit 3325; a transfer function H' multiplying unit 3326; a subtracting circuit 3327; and an adding circuit 3328.

In the example of FIG. 29, an audio signal S through an input terminal 12 is converted into a digital audio signal in an A/D converter circuit 37. The digital audio signal is then supplied to the digital equalizer circuit 3325 in the DSP 332 of an FF filter circuit 33.

An output signal of the digital equalizer circuit 3325 is supplied to a D/A converter circuit 333 via the adding circuit 3328, and is also supplied to the transfer function H' multiplying unit 3326. The transfer function H' multiplying unit 3326 multiplies the output signal of the digital equalizer circuit 3325 by the transfer function H', and then supplies the result to the subtracting circuit 3327.

The subtracting circuit 3327 is supplied with the reproduced acoustic signal of the audio signal S including noise 3 collected by the microphone 31, the reproduced acoustic signal being supplied from an A/D converter circuit 331 via a mike amplifier 32. The audio signal from the transfer function H' multiplying unit 3326 is subtracted from the audio signal S including the noise 3.

Because the transfer function H' is the transfer function from the driver 11 within the headphone casing 2 to the microphone 31 on the outside of the headphone casing 2, the audio signal from the transfer function H' multiplying unit 3326 corresponds to the reproduced acoustic signal of the audio signal S, the reproduced acoustic signal being obtained by collecting sound by the microphone 31. Hence, only the component of the noise 3 is obtained from the subtracting circuit 3327. The output signal of the subtracting circuit 3327 is supplied to the noise analyzing and evaluating unit 3324.

In the noise analyzing and evaluating unit 3324, as described above, the noise component as the input signal is analyzed in the noise analyzing unit, and a result of the noise analysis is supplied to the optimum filter coefficient evaluating unit. As described above, the optimum filter coefficient evaluating unit determines an optimum filter coefficient, and then supplies a result of the determination to a memory controller 35. On the basis of the result of the determination of the optimum filter coefficient, the memory controller 35 reads the optimum filter coefficient from the memory 34, and then sets the optimum filter coefficient in the digital filter circuit 3321.

A noise reducing audio signal generated in the digital filter circuit 3321 is supplied to the adding circuit 3328 to be added to the audio signal from the digital equalizer circuit 3325. The addition output signal is supplied to the D/A converter circuit 333.

As described above, in the ninth embodiment, with the configuration as shown in FIG. 29, it is possible to obtain a difference between a value obtained by estimating the time waveform of the reproduced sound of the audio signal S at the position of sound collection by the microphone 31 and the sound collection audio signal from the microphone 31, and thereby extract only an actual noise component without interrupting the reproduced sound of the audio signal S.

Other Embodiments and Examples of Modification of Automatic Selection System

In the seventh to ninth embodiments described above, noise collected by the microphone 21 or 31 is analyzed, and an optimum filter coefficient is selected using a result of the analysis. It is possible, however, to select an optimum filter coefficient automatically without analyzing the noise.

Specifically, in the noise reducing device of the feedback system, sound at the noise canceling point Pc is collected by the microphone 21, and therefore whether the noise is reduced (cancelled) can be determined from an audio signal of the sound collected by the microphone 21.

Accordingly, in the noise reducing device of the feedback system, when start timing has arrived, the memory controller 25 or 35 sequentially sets a plurality of filter coefficients from the memory 24 or 34 one by one in the digital filter for a predetermined period set in advance, collects residual noise at the noise canceling point Pc at the time of each of the filter coefficients, and then evaluates the residual noise. Then, the filter coefficient corresponding to lowest residual noise is determined as optimum filter coefficient.

Also in this case, when the evaluation is performed, the audio signal S is muted or a silence section of the audio signal S is detected to eliminate the effect of the audio signal S. In addition, as in the embodiment of FIG. 29, a result of multiplying the audio signal S by the transfer function H' may be subtracted from an audio signal from the microphone 21, and residual noise may be detected and evaluated on the basis of the subtraction output.

Incidentally, in the case of the feed forward system, by providing a microphone for collecting sound at the noise canceling point Pc, it is possible to evaluate residual noise at the noise canceling point Pc, and automatically determine an optimum filter coefficient, as described above.

It is needless to say that in cases in which the feed forward system and the feedback system are both used, with a microphone for collecting sound at the noise canceling point Pc, it is possible to evaluate residual noise at the noise canceling point Pc, and automatically determine an optimum filter coefficient.

Other Embodiments and Examples of Modification

In the description of each of the foregoing embodiments, the digital filter circuit in the FB filter circuit and the FF filter circuit is formed by using a DSP. However, the processing of the digital filter circuit can be performed by a software program using a microcomputer (or a microprocessor) in place of the DSP.

When a microcomputer (or a microprocessor) is used in place of the DSP, the part of the memory controller can also be configured by the software program. Conversely, it is possible to configure the part of the memory controller in the DSP.

In the first to fourth embodiments and the seventh and eighth embodiments described above, the equalizer circuit 13 is configured as an analog circuit. However, the equalizer circuit 13 may be configured as a digital equalizer circuit within the DSP as in the fifth embodiment, the sixth embodiment, and the ninth embodiment, or may be configured by the software program of a microcomputer.

As for the microphones for collecting noise in the case of analyzing the noise and automatically selecting an optimum filter coefficient, in the case of a device using a microphone 21 and a microphone 31 as in the fifth embodiment shown in FIG. 17, one of the microphone 21 and the microphone 31 may be used, or both of the microphone 21 and the microphone 31 may be used.

Incidentally, in the seventh embodiment and the eighth embodiment, noise is analyzed, and then an optimum filter coefficient is selected. However, when the noise analysis can be performed accurately, it is expected to be possible to estimate an attenuating curve based on a result of the noise analysis, and calculate a filter coefficient that can provide the estimated attenuating curve. Then, it is not necessary to store a plurality of filter coefficients in a memory.

However, the noise analysis for estimating such an attenuating curve may need a complex and expensive constitution because a fine FFT may be required or a large amount of band-pass filters may need to be used. In this respect, the foregoing embodiments can be formed simply and inexpensively because an accurate attenuating curve is not required, and it suffices simply to be able to determine an optimum attenuating curve among attenuating curves based on a plurality of filter coefficients prepared in advance.

While in the foregoing embodiments, description has been made of a case where a noise reducing audio outputting device according to an embodiment of the present invention is a headphone device, the foregoing embodiments are applicable to earphone devices provided with a microphone, headset devices, and communication terminals such as portable telephone terminals and the like. In addition, a noise reducing audio outputting device according to an embodiment of the present invention is applicable to portable type music reproducing devices combined with a headphone, an earphone, or a headset.

While the noise reducing device section in the foregoing embodiments is provided on the side of the headphone device, the noise reducing device section can also be provided in a portable type music reproducing device into which a headphone device is inserted, or on the side of a portable type music reproducing device ready for an earphone provided with a microphone or a headset.

It should be understood by those skilled in the art that various modifications, combinations, sub-combinations and alterations may occur depending on design requirements and other factors insofar as they are within the scope of the appended claims or the equivalents thereof.

What is claimed is:

1. A method of operating a dynamically configurable active noise cancelling circuit to provide active noise cancelling in an earpiece of a personal audio output device, the method comprising:

incorporating a first microphone input, a first analog-to-digital converter of the active noise cancelling circuit, a first digital filter executed on a digital processing device, an adding circuit, and a digital-to-analog converter of the active noise cancelling circuit into a first pathway;

incorporating a second microphone input, a second analog-to-digital converter of the active noise cancelling circuit, a second digital filter executed on the digital processing device, the adding circuit, and the digital-to-analog converter of the active noise cancelling circuit into a second pathway, wherein the adding circuit is configured to add an output from the first digital filter and the second digital filter before the digital-to-analog converter;

configuring each digital filter of the first and second digital filter with pre-determined filter coefficients specified by a first set of active noise cancelling settings pre-stored in a storage, wherein filter characteristics of the first and second digital filters are configured and changed by setting any of the predetermined filter coefficients in response to an external input that is received from a source that is not the first microphone input or the second microphone input, and the filter coefficients are fixed until receipt of another external input;

operating the first and second analog-to-digital converters, the first and second filters, and the digital-to-analog converter to provide active noise cancelling in the earpiece; and changing a first active noise cancelling mode specified by the first set of active noise cancelling settings to a second active noise cancelling mode specified by a second set of active noise cancelling settings pre-stored in the storage in synchronization with a transfer of digital data along at least a portion of at least one of the first and second pathways, wherein the first analog-to-digital converter, the first digital filter, and the digital-to-analog converter in the first pathway are used for obtaining a first noise reducing audio signal of a feed forward system, and the second analog-to-digital converter, the second digital filter, and the digital-to-analog converter in the second pathway are used for obtaining a second noise reducing audio signal of a feedback system.

2. The method of claim 1, further comprising:

incorporating a third analog-to-digital converter of the active noise cancelling circuit into the first pathway.

3. The method of claim 1, further comprising:

monitoring a characteristic of a sound represented by digital data; and wherein the changing the first active noise cancelling mode specified by the first set of active noise cancelling settings to the second active noise cancelling mode specified by the second set of active noise cancelling settings occurs in response to a change in the characteristic, and comprises changing at least one of the filter coefficients specified by the first active noise cancelling settings.

4. The method of claim 1, further comprising selecting at least one filter coefficient of the second set of active noise cancelling settings to maintain one of a desired quality of sound output by the configurable active noise cancelling circuit and a desired quality of active noise cancelling provided by the configurable active noise cancelling circuit.

5. The method of claim 1, further comprising:

awaiting a receipt of a user operation of an input circuit coupled to the active noise cancelling circuit; and wherein the changing the first active noise cancelling mode specified by the first set of active noise cancelling settings to the second active noise cancelling mode specified by the second set of active noise cancelling settings occurs in response to receiving the user operation.

6. The method of claim 5, wherein the user operation is a touch interaction with the earpiece of the personal audio output device.

7. The method of claim 1, wherein the changing the first active noise cancelling mode specified by the first set of active noise cancelling settings to the second active noise cancelling mode specified by the second set of active noise cancelling settings occurs in response to detecting at least one of the instances of powering the personal audio output device, and the method further comprising receiving an user operation, fixed time interval, or automatically identifying a change of a characteristic of a sound represented by digital data to maintain one of a desired quality of sound output or a desired quality of active noise cancelling provided by the configurable active noise cancelling circuit.

8. The method of claim 7, wherein the digital processing device further comprises an equalizer circuit, and the digital processing device is caused to read a parameter from the storage and set the parameter to the equalizer circuit.

9. The method of claim 1, wherein the second active noise cancelling mode is determined based on noise reducing characteristics pre-stored in the storage.

10. The method of claim 9, wherein a noise reducing characteristics is determined by a noise distribution curve, and the noise distribution curve is at least one of: a low-frequency band, a lower-medium-frequency band, a medium-frequency band, and a wire band.

11. The method of claim 10, wherein:

a curve of the low-frequency band attenuates noise mainly around 100 Hz.

12. The method of claim 1, wherein the first digital filter and the second digital filter are provided in a DSP (Digital Signal Processor), and the storage is provided outside of the DSP.

13. The method of claim 1, wherein the changing the first active noise cancelling mode to the second active noise cancelling mode is performed by configuring each digital filter of the first digital filter and second digital filter with filter coefficients specified by the second set of active noise cancelling settings pre-stored in the storage.

14. The method of claim 1, wherein the source of the external input is a push switch.

15. An apparatus comprising an active noise cancelling circuit, the active noise cancelling circuit comprising:

a first analog-to-digital converter;

a second analog-to-digital converter;

a digital-to-analog converter;

an adding circuit;

a digital processing device; and a storage in which is stored a sequence of instructions that, when executed by the digital processing device, causes the digital processing device to:

incorporate a first microphone input, the first analog-to-digital converter of the active noise cancelling circuit, a first digital filter executed on the digital processing device, the adding circuit, and the digital-to-analog converter of the active noise cancelling circuit into a first pathway;

incorporate a second microphone input, the second analog-to-digital converter of the active noise cancelling circuit, a second digital filter executed on the digital processing device, the adding circuit, and the digital-to-analog converter of the active noise cancelling circuit into a second pathway, wherein the adding circuit is configured to add an output from the first digital filter and the second digital filter before the digital-to-analog converter;

configure each digital filter of the first and second digital filters with predetermined filter coefficients specified by a first set of active noise cancelling settings pre-stored in the storage, wherein filter characteristics of the first and second digital filters are configured and changed by setting predetermined filter coefficients specified by any set of active noise canceling settings in response to an external input that is received from a source that is not the first microphone input or the second microphone input, and the filter coefficients are fixed until receipt of another external input;

operate the first and second analog-to-digital converters, the digital processing device, and the digital-to-analog converter to provide active noise cancelling in the earpiece; and change a first active noise cancelling mode specified by the first set of active noise cancelling settings to a second active noise cancelling mode specified by a second set of active noise cancelling settings pre-stored in the storage in synchronization with a transfer of digital data along at least a portion of at least one of the first and second pathways, wherein the first analog-to-digital converter, the first digital filter, and the digital-to-analog converter in the first pathway are used for obtaining a first noise reducing audio signal of a feed forward system, and the second analog-to-digital converter, the second digital filter, and the digital-to-analog converter in the second pathway are used for obtaining a second noise reducing audio signal of a feedback system.

16. The apparatus of claim 15, further comprising a third analog-to-digital converter of the active noise cancelling circuit incorporated into the first pathway.

17. The apparatus of claim 15, wherein the digital processing device is further caused to monitor a characteristic of a sound represented by digital data, and the changing the first active noise cancelling mode specified by the first set of active noise cancelling settings to the second active noise cancelling mode specified by the second set of active noise cancelling settings occurs in response to a change in the characteristic, and comprises changing at least one of the filter coefficients specified by the first active noise cancelling settings.

18. The apparatus of claim 15, wherein the digital processing device is further caused to select at least one filter coefficient of the second set of active noise cancelling settings to maintain one of a desired quality of sound output by the configurable active noise cancelling circuit and a desired quality of active noise cancelling provided by the configurable active noise cancelling circuit.

19. The apparatus of claim 15, wherein the digital processing device is further caused to await a receipt of a user operation of a input circuit coupled to the active noise cancelling circuit, and the changing the first active noise cancelling mode specified by the first set of active noise cancelling settings to the second active noise cancelling mode specified by the second set of active noise cancelling settings occurs in response to receiving the user operation.

20. The apparatus of claim 19, wherein the user operation is a touch interaction with the earpiece of the personal audio output device.

21. The apparatus of claim 19, further comprising an equalizer circuit;

wherein the digital processing device is further caused to read a parameter from the storage and set the parameter to the equalizer circuit.

22. The apparatus of claim 15, wherein the digital processing device is caused to change the first active noise cancelling mode specified by the first set of active noise cancelling settings to the second active noise cancelling mode specified by the second set of active noise cancelling settings in response to detecting at least one of the instances of powering the personal audio output device, and the digital processing device is caused to receive an user operation, fixed time interval, or automatically identifying a change of a characteristic of a sound represented by digital data to maintain one of a desired quality of sound output or a desired quality of active noise cancelling provided by the configurable active noise cancelling circuit.

23. The apparatus of claim 15, wherein:

the second active noise cancelling mode is determined based on noise reducing characteristics, pre-stored in the storage.

24. The apparatus of claim 23, wherein:

a noise reducing characteristics is determined by a noise distribution curve, and the noise distribution curve is at least one of: a low-frequency band, a lower-medium-frequency band, a medium-frequency band, and a wire band.

25. The method of claim 24, wherein:

a curve of the low-frequency band attenuates noise mainly around 100 Hz.

26. A method of operating a dynamically configurable active noise cancelling circuit to provide active noise cancelling in an earpiece of a personal audio output device, the method comprising:

incorporating a first microphone input, a first analog-to-digital converter of the active noise cancelling circuit, a first plurality of digital filters executed on a digital processing device, an adding circuit, and a digital-to-analog converter of the active noise cancelling circuit into a first pathway;

incorporating a second microphone input, a second analog-to-digital converter of the active noise cancelling circuit, a second plurality of digital filters executed on the digital processing device, the adding circuit, and the digital-to-analog converter of the active noise cancelling circuit into a second pathway, wherein the adding circuit is configured to add an output from the first plurality of digital filters and the second plurality of digital filters before the digital-to-analog converter;

configuring each digital filter of the first and second plurality of digital filters with pre-determined filter coefficients specified by a first set of active noise cancelling settings pre-stored in a storage, wherein filter characteristics of the first and second digital filters are configured and changed by setting any of the predetermined filter coefficients in response to an external input that is received from a source that is not the first microphone input or the second microphone input, and the filter coefficients are fixed until receipt of another external input;

operating the first and second analog-to-digital converters, the first and second plurality of digital filters, and the digital-to-analog converter to provide active noise cancelling in the earpiece; and changing a first active noise cancelling mode specified by the first set of active noise cancelling settings to a second active noise cancelling mode specified by a second set of active noise cancelling settings pre-stored in the storage in synchronization with a transfer of digital data along at least a portion of at least one of the first and second pathways, wherein the first analog-to-digital converter, the first plurality of digital filters, and the digital-to-analog converter in the first pathway are used for obtaining a first noise reducing audio signal of a feed forward system, and the second analog-to-digital converter, the second plurality of digital filters, and the digital-to-analog converter in the second pathway are used for obtaining a second noise reducing audio signal of a feedback system.

* * * * *